United States Patent [19]

Henderson et al.

[11] Patent Number: 4,653,159

[45] Date of Patent: Mar. 31, 1987

[54] FLEXIBLE AUTOMATED MANUFACTURING SYSTEM

[75] Inventors: James A. Henderson, Finksburg; Constantine M. Travlos, Baltimore; Mark L. Holland, Glen Burnie; Ronald C. Vansickle, Columbia; Mark S. Weixel, Ellicott City, all of Md.

[73] Assignee: Westinghouse Electric Corp., Pittsburgh, Pa.

[21] Appl. No.: 881,511

[22] Filed: Jun. 30, 1986

Related U.S. Application Data

[63] Continuation of Ser. No. 670,696, Nov. 13, 1984, abandoned.

[51] Int. Cl.[4] ..... H01R 43/00; B21F 27/00

[52] U.S. Cl. ..... 29/33 M; 29/564.4; 29/564.6; 29/748; 29/755; 29/850; 140/93 R

[58] Field of Search ..... 29/33 M, 566.2, 564.6, 29/564.4, 755, 748, 850, 863; 140/93 R, 93.1

[56] References Cited

U.S. PATENT DOCUMENTS

| | | | |
|---|---|---|---|
| 3,693,228 | 9/1972 | Logan | 29/755 X |
| 3,930,524 | 1/1976 | Tarbox | 29/755 X |
| 3,947,943 | 4/1976 | Kukubo et al. | 29/755 X |
| 4,030,527 | 6/1977 | Roch | 29/755 X |
| 4,107,838 | 8/1978 | Keen et al. | 29/564.6 X |
| 4,114,014 | 9/1978 | Shogo et al. | 29/564.6 X |
| 4,190,890 | 2/1980 | Marx | 29/748 X |
| 4,348,805 | 9/1982 | Gibbons | 29/863 X |
| 4,360,962 | 11/1982 | Suzuki et al. | 29/564.4 |

FOREIGN PATENT DOCUMENTS

| | | | |
|---|---|---|---|
| 59060 | 9/1982 | European Pat. Off. | 29/564.4 |

*Primary Examiner*—William R. Briggs
*Attorney, Agent, or Firm*—W. G. Sutcliff

[57] ABSTRACT

An automated flexible manufacturing system for fabricating electrical cable harness assemblies. The system includes a wire preparation system in which the wires are cut to length, provided with the desired electrical terminations and marked for identification under the control of computing means to which wire harness data is fed. The prepared wires are transported to an automated cable harness assembly system which is also controlled from computing means to which the wire harness data is fed.

7 Claims, 46 Drawing Figures

FIG. 3
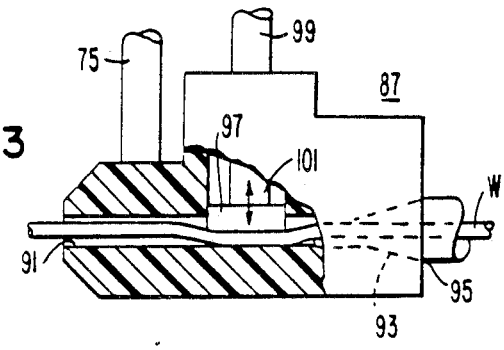
FIG. 4
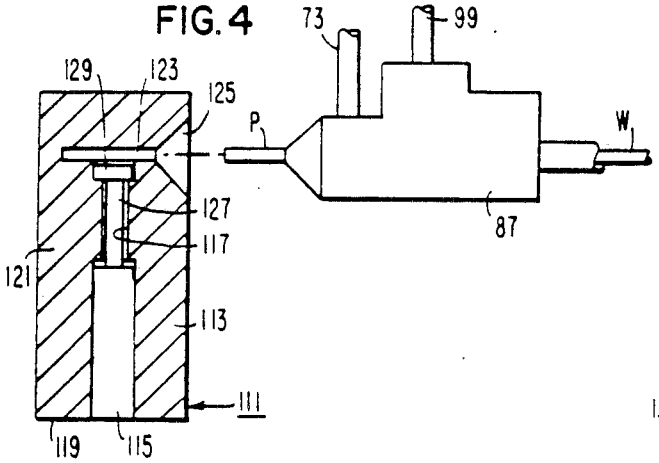
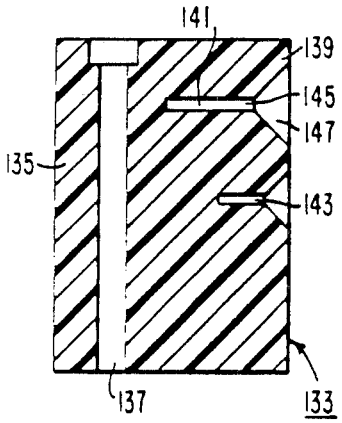
FIG. 5
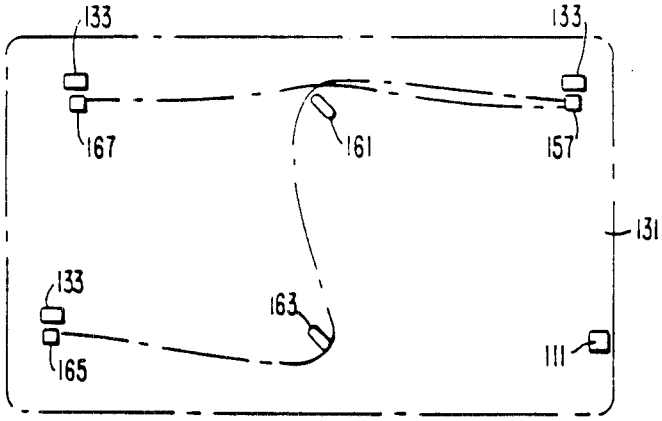
FIG. 6

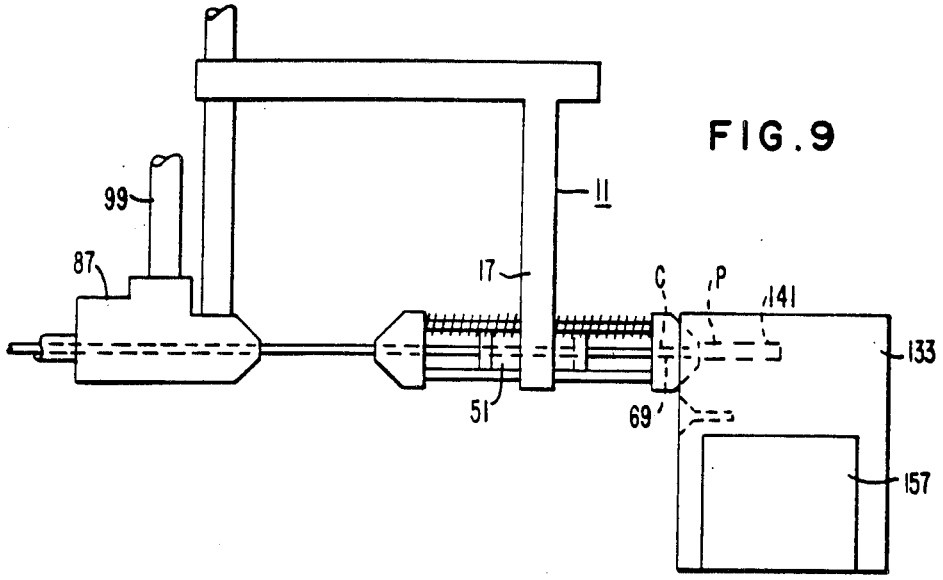
FIG. 9
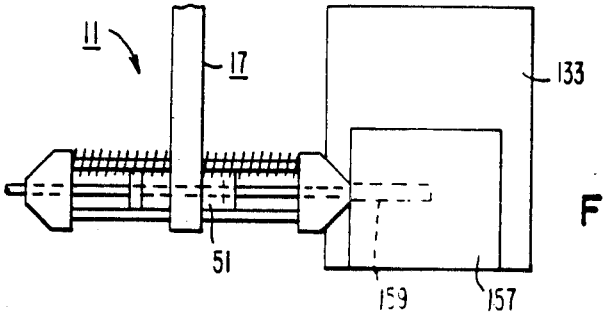
FIG. 10
FIG. 11
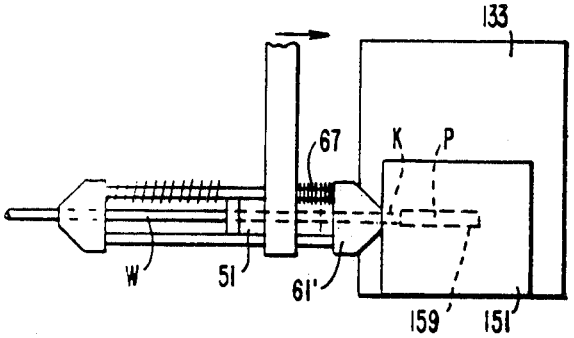

FLEXIBLE AUTOMATED MANUFACTURING SYSTEM

The Government has rights in the present invention by virtue of work down under Contract F19628-81-0101.

This application is a continuation of application Ser. No. 670,696, filed Nov. 13, 1984, now abandoned.

BACKGROUND OF THE INVENTION

The present invention relates to automated manufacturing systems and methods for electrical wire or cable harnesses as are used to interconnect electrical subsystems in large electrical systems, such as radar systems.

In modern radar systems or electro-optical systems, many of the subsystems are modular in design for ease of testing, maintenance, and replacement. These modular subsystems must be electrically interconnected and cable harness assemblies are typically used for this purpose. A radar system manufacturer may have many several radar systems and a variety of other electrical systems in current manufacture. A wide variety of electrical wire or cable harness assemblies are required to be manufactured. These cable harnesses will have a wide variety of wire sizes, lengths, electrical terminations, and wire routing paths.

It has been the practice in the industry to utilize a wire formboard to permit manual routing of the wires in laying out the cable harness in the desired assembly path. This manual routing is time consuming and requires numerous checks of the accuracy of wire selection and routing.

It is desired to provide an automated wire preparation system and cable harness assembly system to permit accurate, low-cost manufacture of these cable harnesses.

SUMMARY OF THE INVENTION

An automated system for taking manufacturing and design data for cable harnesses and using this data to control automated preparation of predetermined diameter and length wires. These wires are terminated at each end with predetermined termination means. The selection of the wire, cutting it to length, and terminating the wire ends is carried out by a wire preparation system which is operated under the control of computing means, which can be a general purpose digital computer or special purpose microprocessor means.

The terminated wires are fed from the wire preparation system, either automatically by a conventional robot with appropriate end effector for grasping the terminated wire ends, to the cable harness forming system. The cable harness forming system is operatively controlled by computing means to which the manufacturing and design data for a specific desired cable harness is fed. This computing means can be the same computing means as used to control the wire preparation system or a separate one. The manufacturing and design data base serves both the wire preparation system and the cable harness assembly system. This cable harness forming system is a robot system, again with appropriate end effector, which sequentially lays or routes the individual wires along a planar formboard. The formboard has a predetermined pattern of restraints extending vertically from the planar formboard. The robot end effector graps a first terminated wire end and routes the wire in a predetermined pattern along the formboard about the restraints which serve to define the cable path, and to hold the sequentially routed wires in place until all the wires of the cable harness are routed in place, and are bundled together with cable ties along the length of the cable.

This bundled and tied cable harness with a plurality of individual wires, with a variety of terminations, and typically several sub-branches of cable extending from the main trunk cable harness, is removed from the cable harness system and is ready for use to interconnect spaced electronic components or subsystems.

BRIEF DESCRIPTION OF THE DRAWINGS

The above as well as other features and advantages of the present invention can be readily appreciated through consideration of the detailed description of the invention in conjunction with the several drawings, in which:

FIG. 3 is a detail of the wire tensioning and centering device associated with the end effector;

FIG. 4 is an elevational cross-sectional view of a stationary clamp apparatus mounted on the wire harness formboard which aligns and secures the pin and positions it for pick-up by the insertion gripper;

FIG. 5 is a cross-sectional elevational view of an alignment fixture for use in combination with the insertion gripper;

FIG. 6 is a schematical plan view of a wire harness formboard layout;

FIG. 9 is a schematical elevational view of the alignment fixture in position with the gripper and wire connector;

FIG. 10 is a schematical elevational view of the gripper aligned with the proper hole in the connector and inserting the protruding pin into the connector;

FIG. 11 is a schematical elevational view of the robot gripper with the inner clamps of the assembly tool gripper grasping the wire and inserting the pin into the connector;

DESCRIPTION OF THE PREFERRED EMBODIMENT

FLEXIBLE AUTOMATED CABLE HARNESS FABRICATION SYSTEM

Figure 1:
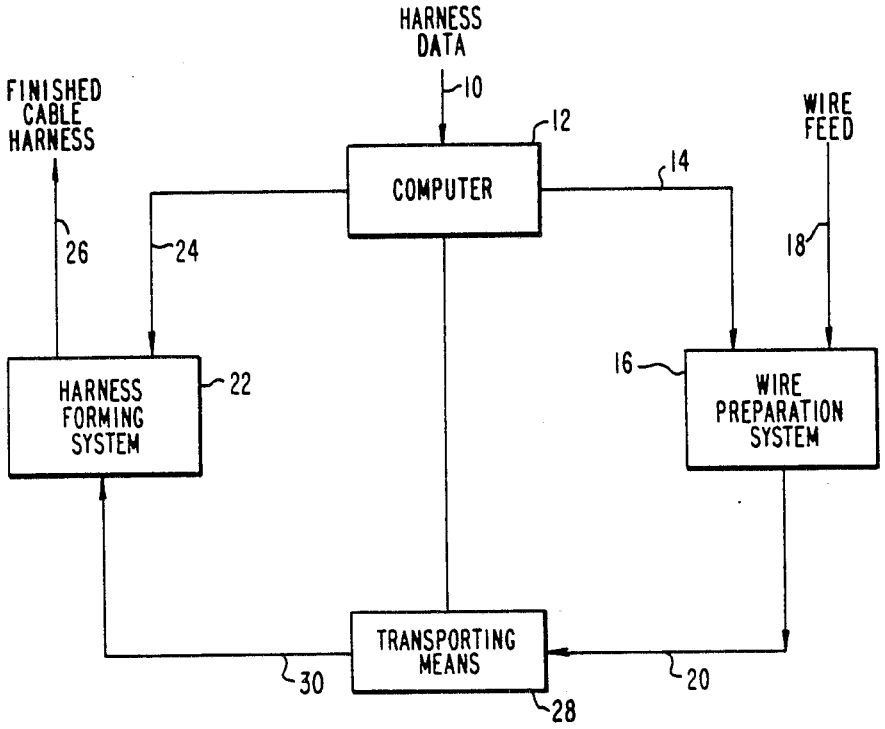
FIG. 1 is a schematic illustration of the automated manufacturing system of the present invention.

The automated system for forming electrical cable harnesses is seen schematically in FIG. 1, wherein cable harness design data is directed on line 10 to computer means 12. The cable harness data is typically in a format produced by a CAD system, which is used to design the large numbers of unique cable harnesses as are required for example by a radar system manufacturer. The present automated system is designed to provide a very flexible manufacturing capability since there is such a wide variety of cable harnesses which must be fabricated for use with wide varieties of electronic subsystems as are used in radar systems.

The computing means 12 may be a general purpose digital computer or a microprocessor means with appropriate software and memory. The computing means 12 accepts the cable harness data and generates control signals along line 14 which are fed to automated wire preparation system 16. This wire preparation system 16 is described in greater detail hereafter. The function of the wire preparation system 16 is to take wire fed along line 18 from wire storage means not shown, cutting the wire to length, terminating the wire ends with the desired termination means, marking the wire with identifying information which permits visual checking and documenting of proper cable fabrication. In the wire preparation system described in detail hereafter the wire feed and wire storage means is actually part of the wire preparation system and in FIG. 1 this wire feed is shown separately to facilitate understanding of the broader automated cable harness manufacturing system.

The terminated wires which are sequentially prepared by the wire preparation system 16 are then fed along line 20 to the transporting means 28 and therefrom along line 30 to the cable harness forming system 22. The transporting means 28 for feeding the terminated wires to the cable harness forming system 22 can be as simple as a manual operator, or more typically an automated robotic system with an appropriate end effector for grasping the terminated wire and removing same from the wire preparation system 16 and transporting the terminated wire to the cable harness forming system 22.

This cable harness forming system 22 is described in greater detail hereafter, and performs the function of sequentially laying or routing the individual terminated wires along a predetermined cable path according to control signals directed along line 24 from the computer means 12 to the cable harness forming apparatus 22. The cable harness forming apparatus 22 includes robot means with appropriate end effector, with the robot means being operable in Cartesian coordinates to route the wire over a formboard upon which cable is assembled in a predetermined path as defined by the stored harness design data which is fed to computer means 12. The terminated wires are routed in sequence until the entire cable harness is fabricated, with appropriate ties or bundling means about the wires. Such cable harness will typically extend for several feet and have plural branch paths extending from a prime trunk path, which trunk path may be formed to permit the cable to fit precisely within its intended environment, which is to interconnect electronic subassemblies. These subassemblies may be modular electronic units which are easily tested and are replaceable as LRU's (line replaceable units) as in a modern airborne radar system.

The finished fabricated cable harness is seen as being removed along line 26 from the cable harness forming apparatus 22. The flexible automated cable harness fabrication system of the present invention is then ready to fabricate another cable harness which can be identical to the previously made cable harness using the same cable harness design data, or to form a different cable harness based on the unique cable harness design data for such different cable harness. Thus, the system of the present invention is capable of fabricating the thousands of unique cable harnesses as are required for modern electronic systems manufacturers.

AUTOMATED WIRE HARNESS ASSEMBLY

In order to begin assembly, a selected end effector must first acquire and load the wire for insertion. As described above, the wire has been prepared in a wire preparation cell at which the wire was cut to a predetermined length. Both ends of the wire were then trimmed and each end of the wire terminated with an appropriate connector which can be crimped or soldered in place. The appropriately terminated wire is then transported either through an automated system or by a manually actuated technique for presentation to a selected end effector. One such technique by which a terminated wire is presented to an end effector is a pneumatic wire transport system. Generally, the pneumatic wire transport system includes a wire feed means and an air supply. A pneumatic delivery tube extends between the wire feed means and the end effector loading point. The prepared wire is delivered to the feed means and is then driven by air pressure through the tube to a location where one end of the terminated wire can be engaged by a selected end effector. A detailed description of the technique whereby a terminated wire is so transported and engaged by an end effector is described hereinafter.

Figure 15:
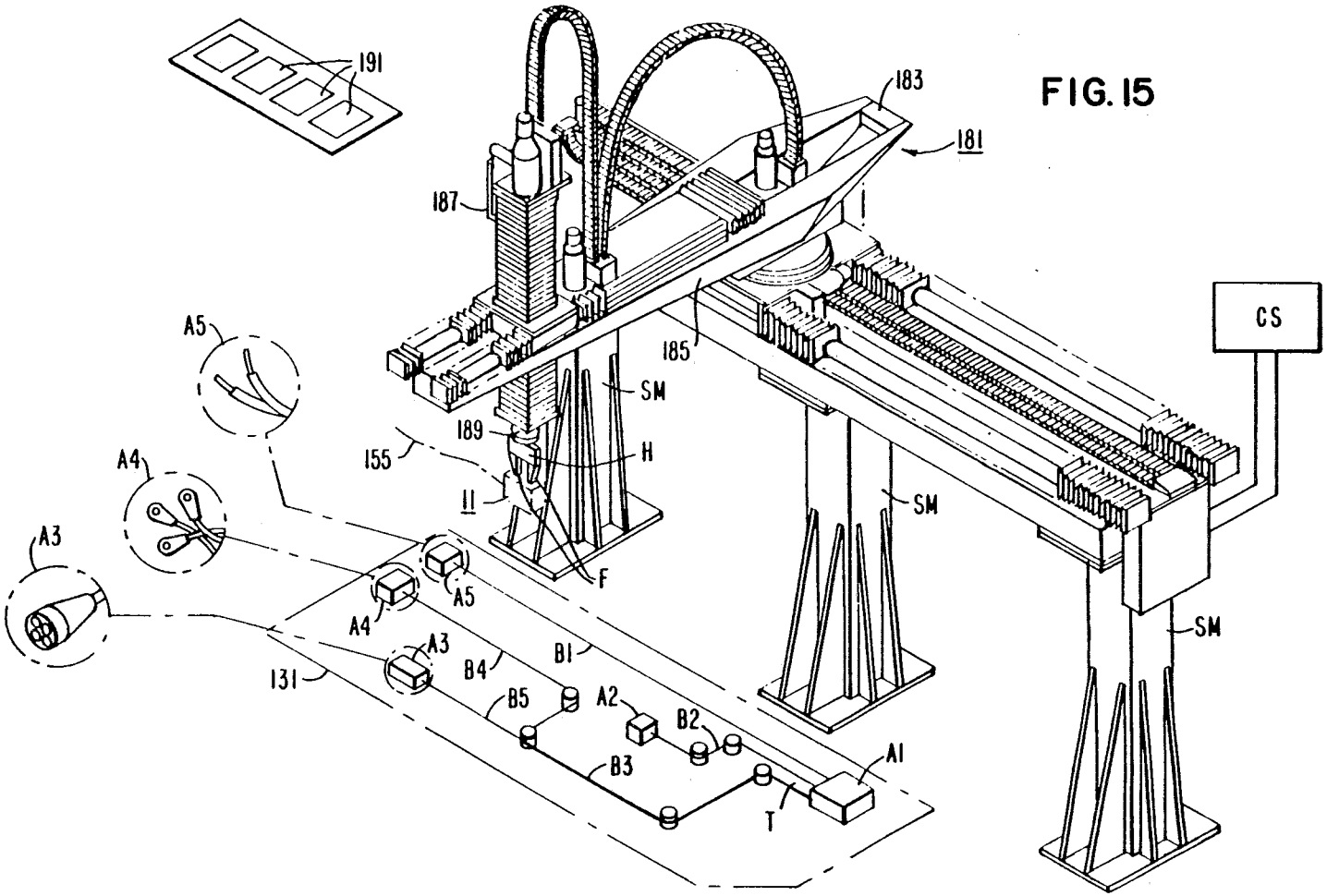
FIG. 15 is a schematical representation of a robotic manufacturing cell utilizing a UNIMATE Series 6000 electric robot with universal quick changing tooling adapter for use in combination with the end effector illustrated in FIG. 2 above.

The actual wire harness assembly system utilizes an industrial manipulator for the positioning and directing of the end effector through a predetermined wire harness path. By way of an example, a gantry design orthogonal axes manipulator system is illustrated in FIG. 15. Such a robot is particularly useful because it permits programming in Cartesian coordinates. A wire harness assembly formboard generally indicated by the reference character 131 is disposed within the work envelope of the manipulator. The manipulator system 181 comprises three orthogonal axes assemblies consisting of the X axis assembly 183, the Y axis assembly 185, and the Z axis assembly 187. An optional multiple axes rotary wrist mechanism 189 is secured to the Z axis assembly 187 to accommodate a general purpose robotic hand H. The general purpose robotic hand H includes finger means F which are adapted to engage and manipulate any one of a plurality of individual end effectors. Due to the complexity of wire harness manufacture and the variety of connectors which can be found in a given wire harness, it is advantageous to utilize several dedicated end effectors generally indicated at the reference character 191. One example of such a dedicated end effector for wire harness assembly is a bidirectional connector pin insertion tool which will be described in detail hereinafter.

The operative combination of the X, Y and Z axis assemblies is supported in a gantry-type configuration by the vertical support members SM which are secured to the floor of the work facility. Machine tool type control of the operation of the manipulator system 10 is implemented by the conventional numerical control console CS, such as the PRODUCER TM CNC System which is available from the Westinghouse Electric Corporation. This gantry configuration of an orthogonal axes manipulator system significantly reduces the number of wrist articulations required to implement the desired wire harness assembly process and further reduces requirements for auxiliary devices such as a rotating table onto which a formboard typically would be mounted.

The formboard generally indicated at the reference character 131 is prepared for a wire harness having a trunk T from which a plurality of individual branches B1–B5 extend therefrom. This is a rather simple wire harness and is shown for illustrative purposes only. It is to be appreciated that due to the complexity of electronic equipment as well as the fact that the modular components which typically make up a given electronic system may be physically separated from each other, both the length of the individual branches as well as the number of branches and the connectors which terminate each branch are unique to the given system for which the harness is dedicated. The formboard 131 also includes a plurality of assembly points indicated at A1–A5 and standoff members or wire routing pins indicated by the reference character R. It should be appreciated that the actual disposition of the wires in the wire harness is one of manufacturing requirement and dictated by the application of the wire harness itself. Accordingly, any number of a variety of standoffs and connectors can be used in conjunction with the present system and the technique described herein. As shown in the enlarged views of assembly points A3, A4 and A5, any number of a variety of wire terminations can be present in a given wire harness. For example, the enlarged view of assembly point A3 illustrates a standard military connector into which a large number of individual pin-type connector terminated wires is inserted. The manufacturer of a high density wire harness utilizing such connectors and the specific end effector dedicated to the insertion of such pins into a connector is described in detail below. The enlarged view of assembly point A4 illustrates conventional lug-type connectors and the enlarged view of assembly point A5 illustrates a simple stripped and tinned lead prepared for assembly at a later time.

For the purpose of providing a general overview to the process by which a wire harness is manufactured, the following outline of the individual steps in the manufacturing process is presented. Initially, the hand H of the gantry-type robot 181 engages a selected end effector compatible with the particular type of wire being inserted. Upon acquisition of the appropriate end effector, a terminated wire is presented to that end effector by way of the wire transport system. The terminated wire is then loaded into the selected end effector. The terminated wire is aligned as required in the end effector and then the end effector is positioned so that the first end of the terminated wire is proximate a desired first assembly point. The first end of the terminated wire is then inserted into the first assembly point and the routing of the terminated wire along a predetermined cable harness layout path is initiated. It should be noted that while the end effector described in detail below is utilized for both wire routing and wire insertion, it may be practical to utilize a separate gripper for the terminated wire insertion process and a separate gripper for the wire routing process. When separate grippers are used for each task, dedicated grippers as at 191 are selectively utilized by the hand H of the robot. The robot then follows a predetermined path to route the wire along the standoffs as necessary to bring the wire to its second selected assembly point. The second end of the terminated wire is then loaded into the selected end effector for insertion at that assembly point. Obviously, depending upon the configuration of the wire harness, the second selected assembly point may be no more than a final location in which the wire is deposited onto the formboard as in the case with assembly points A4 and A5. The above-described steps are repeated until the wire harness is completed. Upon completion of the assembly of the wire harness, the wire harness is removed from the formboard 131 and the formboard is then prepared for the manufacture of the next wire harness by the mounting of appropriate standoffs and connectors as required.

Having thus generally described a technique and apparatus by which high density wire harnesses can be manufactured, it may be useful to provide by way of example a specific end effector dedicated to the assembly of complex wire harnesses utilizing multiple plug connectors. It has been found preferable to use an orthogonal axes manipulator system, such as the UNIMATE Series 6000 electric robot described above. A dedicated end effector is illustrated in an exploded isometric view in FIG. 2 with a detail of a portion of that gripper shown in FIG. 3. The end effector, generally indicated by the reference character 11 comprises a pair of mounting brackets 13 and 15, an assembly tool 17 and a wire tensioning and centering tool 19. The mounting brackets 13 and 15 of the end effector 11 include mounting holes 21 therein which permit the end effector 11 to be removably attached to a robotic hand, a bayonet-like mount for use in conjunction with a robot hand or any type of mounting configuration indigenous to the particular host robot to which the gripper or end effector is being attached. As schematically represented in FIG. 15 a robot hand indicated at H has a pair of fingers indicated at F. These fingers can be adapted to receive the mounting brackets 13 and 15 therein. Once such a mounting is used, the selective movement of the fingers F toward and away from each other causes the outer gripper jaws mounted on the brackets 13 and 15 to move toward and away from one another. The mounting bracket 13 is a generally L-shaped member from which a cantilevered arm 23 extends. The cantilevered arm 23, which provides a mounting point for the movable wire tensioning and centering tool 19, can be either an integral member of the bracket 13 or a separate member securely attached thereto.

Each of the mounting brackets 13 and 15 support the assembly tool 17. The assembly tool 17 consists of two symmetrical parts 25 and 27. The two symmetrical parts or two halves 25 and 27 of the assembly tool 17 function together in a jaw-like fashion to receive, engage and then route a wire to a connector or an assembly point. Each half 25 or 27 of the assembly tool is double ended as at 29 and 31 of the symmetrical half 25, and double ended as at 33 and 35 of the symmetrical half 27. As will be described in detail below, the assembly tool is double ended so that wire may be inserted into a connector by either the left or right half of the assembly tool. For the sake of clarity during description, the assembly tool 17 will be described as having a left half indicated at L, a right half indicated at R, a front portion indicated at F and a rear portion indicated at R. The wire transport tool can be seen to be located at what is designated the rear portion of the end effector. However, as will be described in detail below, in actual practice there is no front or rear to this double-ended assembly tool.

The left "L" portion of the assembly tool includes a strut 37 which is defined by the downwardly depending L-shaped portion of mounting bracket 13. The strut 37 includes a pair of bores 39 and 41 extending therethrough. Additionally, a V-shaped seat 43 is provided on the inner surface of the strut 37. A bore 45 extends from the bottom of the V-shaaped seat 43 outwardly through the strut member 37. A pneumatic cylinder 47 is mounted in the bore 45 and the piston 49 of the pneumatic cylinder 47 extends out through the V-shaped seat 43. An inner insertion clamp 51 is mounted on the piston 49 of the pneumatic cylinder 47. The inner insertion clamp 51 includes a V-shaped base portion 53 adapted to rest in the V-shaped seat 43 when in a first, or retracted position. A jaw-like portion 55 at one end inner clamp 51 is adapted to engage the opposed side of a second, symmetrical inner clamp 51' mounted on the right-handed bracket. The interaction of the left-handed inner clamp with the right-handed inner clamp will be described in detail below. The clamp is selectively activated to grip and release a wire held by the tool.

A pair of rods 57 and 59 are slideably mounted in bores 39 and 41 of strut 37 and extend outwardly therefrom in the directions indicated as front and rear of the gripper. A first collet 61 and 61' is mounted at the forward end of rods 57 and 59 and a second collet 63 and 63' is mounted at the back or rear end of rods 57 and 59. As can be seen from the view of FIG. 2, each collet comprises a first and second and second half, i.e. 61 and 61', and 63 and 63', which cooperate to support and guide the wire to its termination location. The collets are kept in a first or neutral position relative to the strut by a pair of springs 65 and 67 coiled about at least one of the rods on opposed sides of the strut 37 as illustrated herein. It is, of course, possible to provide biasing means on either the upper rod 57, the lower rod 59 or both the upper and lower rods. This construction allows the strut to slide closer to a selected collet and then back to a neutral position during pin insertion into a connector. Each of the collets 61, 61', 63 and 63' includes a channel 69 therein which cooperates with the channel of an opposed collet to form a bore through which the wire slides during the transport of the wire about the formboard by the end effector 11. Additionally, each of the collets can include a pair of knife edge as at 71 which cooperate with the knife edges of an opposed collet to more securely align the mated collets and guide the wires therethrough. To facilitate both the mating and alignment of the collet pairs 61 and 61' and 63 and 63', at least one and preferably two pin and bore alignment systems are provided. On each of the collets 61 and 63 there is provided a pair of bores 60 disposed above and below the channel 69. On each of the collets 61' and 63', there is provided a pair of pins 62 which are adapted to be received by the bore 61 opposite thereto. The combination of the pins and bores in each of the collets provides both stabilization to the gripper and alignment of each of the gripper halves with the other whenever the assembly tool 17 is in its closed position.

As can be seen by mounting the end effector 17 on the end of a conventional robot hand having the capability of spreading mounting brackets 13 and 15 apart from one another, the inner clamps 51 and 51' are capable of being engaged independently from the outer clamps collets 61, 61', 63 and 63 of the assembly tool.

Figure 2:
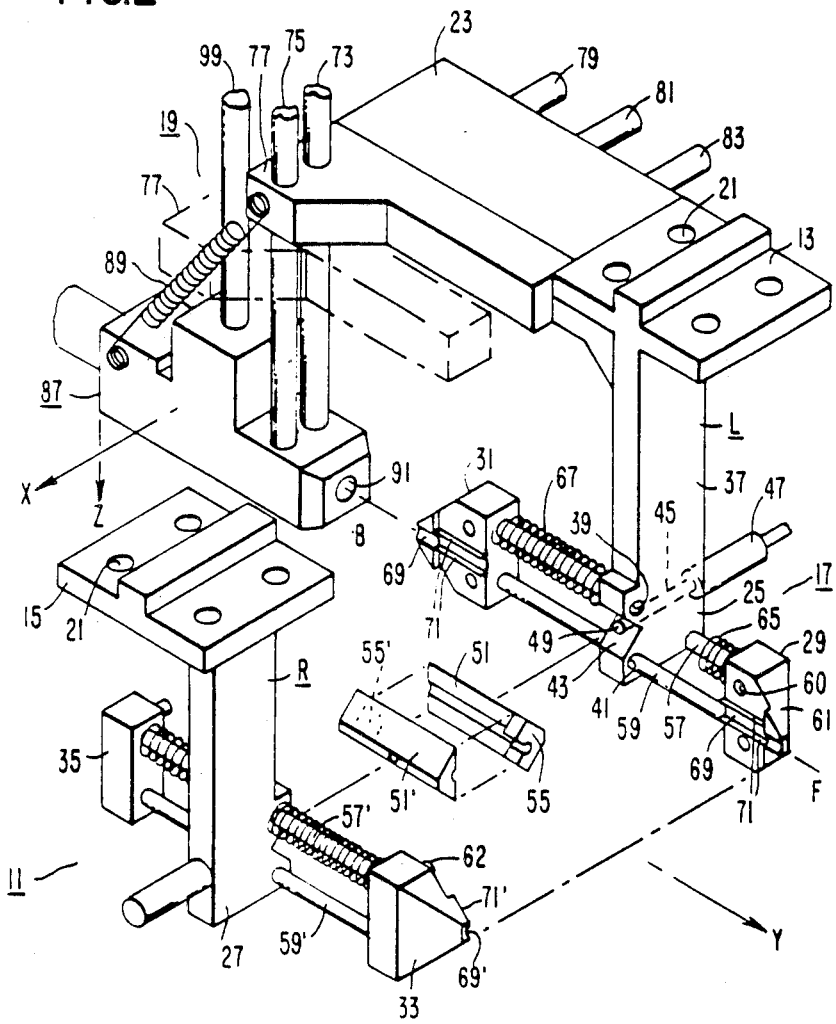
FIG. 2 is an exploded isometric view of the wire harness assembly tool end effector.

Considering both FIGS. 2 and 3, the wire tensioning and centering tool 19 of the end effector 17 is mounted for independent movement along both an X axis and a Z axis, as shown in FIG. 2, in order to maintain a center position of its wire feed mechanism with respect to the independent movement along the X axis of the brackets 13 and 15 with their jaw assemblies therein. The tensioning and centering tool 19 is mounted for movement along a Z axis by at least one and preferably two pneumatic cylinders 73 and 75 which are mounted on bracket member 77. The bracket member 77 is in turn supported by at least one and preferably three pneumatic cylinders 79, 81, and 83 which are mounted on the rearwardly extending cantilevered arm 23 of mounting bracket 13. More particularly, bracket 77 is fixedly attached to the pistons of each of the cylinders 79, 81 and 83 for movement in an X axis direction as shown in dash-dot line. The main body portion of the wire tensioning and centering tool 19 is the tensioning and centering device 87 which is adapted for movement along the Z axis by means of the pistons in pneumatic cylinders 73 and 75 which are secured to and depend downwardly through bracket member 77. It will be seen that during normal operations of this end effector, the pneumatic cylinders 73 and 75 are actuated so that the tensioning and centering device 87 is at a first or maximum extended position in a downward, or Z axis direction relative to bracket member 77. When the penumatic pressure is removed from cylinders 73 and 75, the tensioning and centering device 87 retracts to a second or elevated position with respect to the assembly tool 17. This elevation can be accomplished through internal springs mounted in the pneumatic cylinders 73 and 75 or it can be effected through the use of a biasing means, such as spring 89 extending between the bracket member 77 and the tensioning and centering device 87.

The tensioning and centering device 87 of the wire tensioning and centering tool 19 includes a bore 91 extending therethrough. The end of the bore distal from the assembly tool jaws can be preferably funnel-shaped as at 93. The pneumatic wire transport system is adapted to be connected to the tensioning and centering device 87 as at 95 in order to convey a wire having its connector pin clamped thereon to the wire transport tool. A clamp means 97 (FIG. 3) is disposed within the tensioning and centering device 87 and is adapted to engage a wire "W" (FIG. 3) inserted therethrough by the wire feed means. The clamp member 97 preferably consists of a pnuematic cylinder 99, the piston of which 101 is connected to the clamp means 97. Upon actuation of the pneumatic cylinder 99, the clamp member 97 is urged downwardly and engages the wire by securing it against the bottom wall of the bore 91. The actual functioning of the tensioning and centering device of the wire transport tool will be described in detail in association with the wire transport system as well as in connection with the description of the actual manufacture of a wiring harness hereinafter below.

An elevational, sectional view of a stationary clamp generally indicated by the reference character 111 is shown in FIG. 4 along with a rather limited schematical view of the tensioning and centering device 87 of the end effector 11 as shown in FIG. 2. The stationary clamp 111 comprises a generally rectangular member 113 which is mounted onto a formboard as will be described hereinafter. The stationary clamp 111 has a pneumatic piston 115 mounted in a bore 117 extending from the base 119 toward the upper region 121 of the block. Substantially perpendicular to the bore 117 is a contact receiving bore 123 dimensioned to receive therein a contact pin "P" crimped on the end of a wire to be routed on the formboard. The bore 123 is countersunk as at 125 to permit the crimped contact P to be received into the bore 123. The pneumatic cylinder 115 includes a piston 127 having a clamp means 129 disposed at the end thereof distal from the cylinder 115. When the contact P is received into the bore 123, the pneumatic cylinder 115 is actuated causing the clamp means 129 to positively retain contact P within the bore 123.

The stationary clamp 111 is mounted onto the formboard 131 shown in FIG. 6 in a schematical plan view. The stationary clamp 111 is fixedly positioned onto the formboard 131 at a location which is generally removed from the typical route to be followed during wire harness manufacture. The manner in which the stationary clamp 111 cooperates with the end effector 11 will be described in detail below.

Turning to FIG. 5, an alignment fixture is generally indicated by the reference character 133 and briefly referring to FIG. 6, the alignment fixture can be seen located at multiple positions on the formboard 131. These positions are generally selected to be located adjacent the connectors to which the wires are assembled. The alignment fixture 133 comprises a block 135 having therein a mounting bore as at 137 which permits the alignment fixture 133 to be positively yet removably secured to the formboard 131 by a securing screw, clamp or the like, not shown herein. On at least one face 139 of the alignment fixture 133, at least one alignment bore is provided as at 141. The alignment bore 141 permits contact pin to be aligned with the collet of the assembly tool 17 as shown in FIG. 2 prior to the actual insertion by the assembly tool of the contact P into the connector. A plurality of alignment bores as at 141 and 143 can be provided in one face 139 of the alignment fixture 133. More particularly, the alignment bore 141 consists of an elongated passage 145 adapted to receive therein the contact P (FIG. 4) and a countersunk portion 147 into which the nose of the collet rests during alignment. The alignment bore 143 is dimensioned differently to accommodate a different size connector pin. It should be obvious that any number of alignment bores can be provided with a variety of internal configurations adapted to suit a variety of connector pins.

FIGS. 7 through 14 schematically illustrate the several steps utilized in the manufacture of a wire harness according to the method and apparatus of this invention. Moreover, these several features demonstrate the operation of the end effector 11 illustrated in FIG. 2. FIG. 15 shows a UNIMATE Series 6000 electric robot which can be used in combination with the wire delivery system and end effector described herein to manufacture wire harnesses. Reference will be made from time to time to the formboard shown in FIG. 6 in order to relate the actual steps schematically shown in the several figures to the actual manufacture of the wiring harness.

Figure 7:
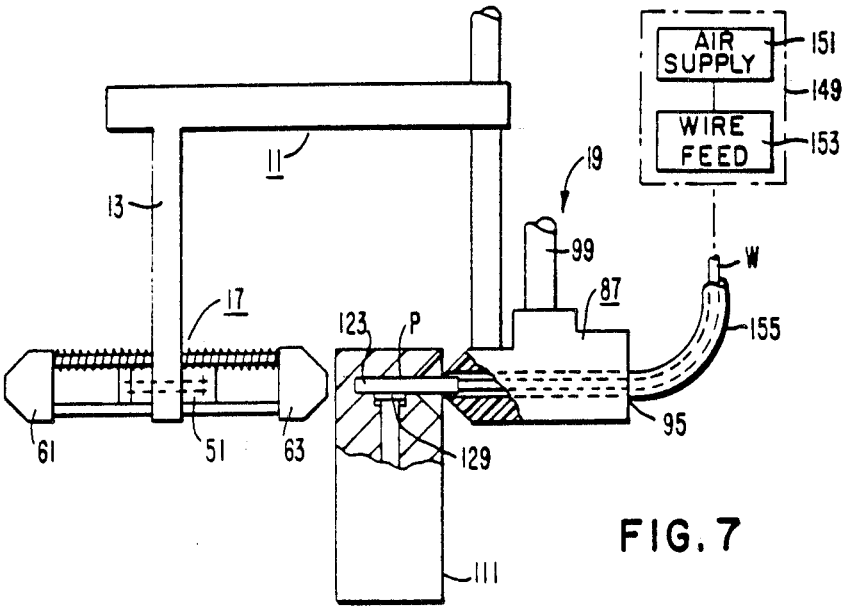
FIG. 7 is a schematical, elevational view of the wire entering a stationary clamp on the formboard wherein the stationary clamp aligns the wire, secures the pin, and positions the wire for pick-up by the insertion gripper.

Turning now to FIG. 7, in order to begin assembly, the gripper 11 must first acquire and load the wire W for insertion. The wire is prepared in a wire preparation cell at which a wire is cut to a predetermined length. Both ends of the wire are trimmed and each end of the wire is terminated with contacts which are crimped in place. Wire would then be transported either through an automated system or by a manually actuated technique to the pneumatic system for transporting wires to the end effector for harness assembly. The prepared wire pneumatic delivery system is generally indicated at reference character 149 of FIG. 7 and includes a wire feed means 153 and, an air supply 151 and a pneumatic delivery tube 155. The prepared wire is delivered to the feed means 153 and is then driven by air pressure through the tube 155 to the wire tensioning and centering device 87 quickly and smoothly. Each wire is loaded into an entry point fixture, i.e., the feed means 149 and sealed therein. The wire is then blown, with about 80 psi of back air pressure at an approximate rate of 25 feet per second, to the wire tensioning and centering device 87. A bank of Mac air valves has been interfaced through a parallel port for programmable control of the air pressure. The flexible tubing 155 preferably is made of inexpensive polyvinyl chloride tubing (PVC). The tube 155 terminates as at 95, in the tensioning and centering device 87 of the gripper 11. The contact P of the wire W enters the stationary clamp 111 on the formboard. After the wire contact P enters the contact bore 123, the clamp means 129 engages the contact by means of the actuation of the pneumatic cylinder 115 (see FIG. 4). In other words, after the wire enters the stationary clamp, an air cylinder is activated which secures the contact pin P of the wire and positions the wire for pick-up by the assembly tool 17. As can be appreciated through viewing both FIG. 2 and FIG. 7, at this point during the process, the jaws or right and left halves of the assembly tool 17 are in a spaced apart position so that both the right and left halves of the jaw can straddle the stationary clamp 111 as the gripper moves on axis, feeding the wire from the tube 155 through the tensioning and centering device 87 thus positioning and centering the wire W for pick-up by the assembly tool.

Figure 8:
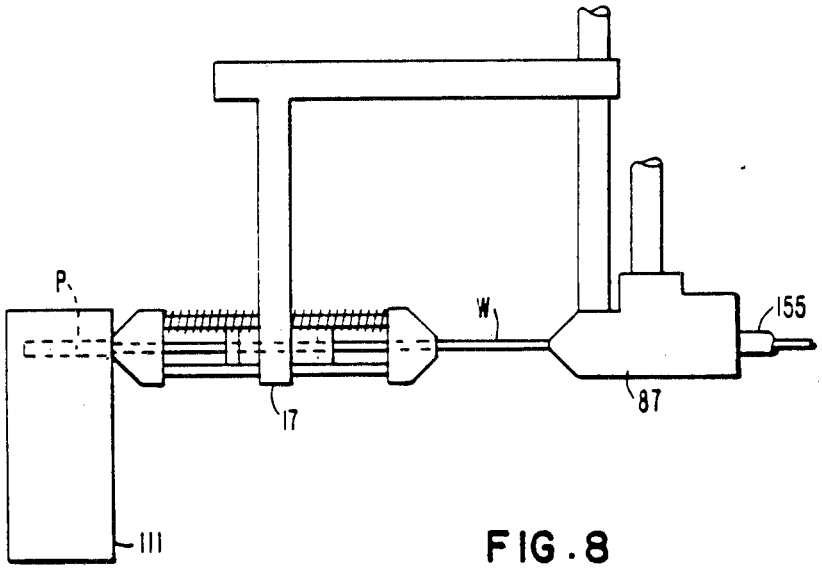
FIG. 8 is a schematical elevational view of the gripper moving on axis to feed the wire from the tube and closing on the shoulder of the pin.

Turning to FIG. 8, it can be seen that the tensioning and centering device 87 has moved on axis away from the stationary clamp 111 so that both the tensioning and centering device 87 of the gripper 11 as well as the assembly tool 17 are on the same side of the stationary clamp 111. The internal clamp means 101 shown in FIG. 3 of the tensioning and centering device 87 is activated thus ensuring the proper tautness and positioning of the wire. At this point, the right and left halves of the assembly tool 17 are closed together in order to position the wire within the channel 69 defined by the collets 61, 61', 63 and 63' of both the right and left halves of the alignment tool. The head consisting of collets 61 and 61' of the gripper now closes on the shoulder S of the pin P, the stationary clamp means 129 deactivates and the gripper grasps the wire. The wire is now ready for verification of proper position for insertion. The collet pair 61 and 61' at the forward end of the gripper 11 has now engaged the crimped portion C of the contact pin P which is aft of the shoulder portion S and securely holds the crimped portion for transport of the wire to the various other stations on the formboard.

As can be seen on the formboard of FIG. 6, the gripper 11 is manipulated by the overhead robot to remove the wire from the stationary clamp 111 (as illustrated in FIG. 8) and convey the wire to the first assembly point represented by connector 157. Throughout this operation, the wire itself is merely being repositioned along with the gripper. The wire is not being conveyed through the tube. Proper position of the pin P for insertion is verified using the alignment fixture 133 adjacent the connector 157 on formboard 131. While in this illustration, the alignment fixture 133 is mounted alongside of the connector 157, it can be appreciated that an integral mount can be provided which holds both the connector and the alignment fixture. In actual practice, as shown in FIG. 9, the assembly tool 17 inserts the connector pin P into the bore 141 which is designed to accommodate the particular contact pin being inserted. The insertion gripper momentarily open while the alignment fixture accurately repositions the pin with respect to the gripper for insertion. Once alignment has been completed, the gripper jaws close, causing the assembly tool to once again securely position the crimped portion of the connector within the bore 69.

Figure 12:
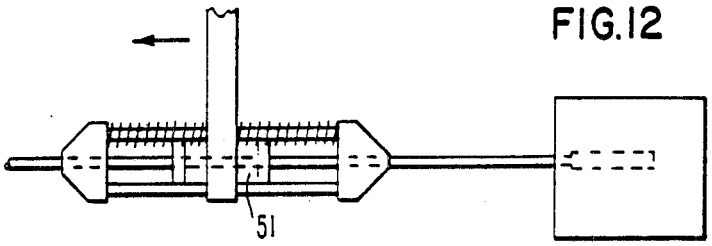
FIG. 12 is a schematical elevational view of the robot gripper testing the wire pin seating in the connector.
Figure 13:
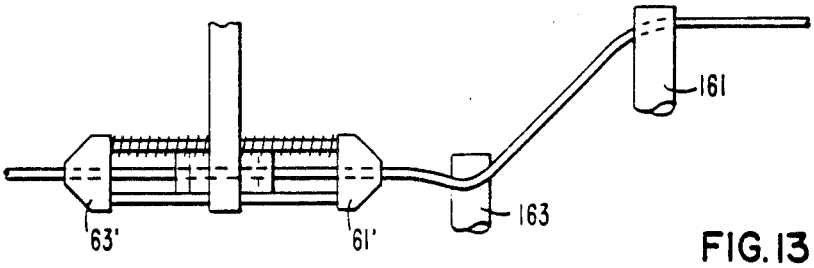
FIG. 13 is a schematical elevational view of the robot gripper pulling the wire through the tool and routing the wire about the standoffs on the formboard.

Considering now FIGS. 10 and 11, first, the assembly tool via the gripper 11 aligns itself with the proper hole 159 in the connector 157. The robot inserts the protruding pin P into the connector bore 159, until the strain gauges on the robot wrist sense the force increasing. If the pin P has not penetrated the connector far enough, which would indicate an obstruction, the robot would retract and retry the insertion until the position is correct or the robot will stop and signal for help if incorrect. Once the connector pin P has been properly inserted into the bore 159 of the connector 157, the assembly tool opens slightly so that the collets 61, 61', 63 and 63' which define the outer clamp no longer engage the crimped portion C of the connector pin. At this point, the internal clamps 51 of the assembly tool 79 are actuated by the appropriate pneumatic cylinders in order to grasp the wire. The robot arm now moves the struts toward the assembly point, i.e., the connector 157. The lateral movement of the robot arm forces the springs 67 to compress. This compression action pushes the strut closer to the collet 61, 61' urging the wire forward and further forcing the pin to seat in the assembly point. Thus, the movement of the strut with the internal clamps 51 relative to the collet pushes the wire into the connector until force sensing indicates that the pin has bottomed into the connector. This step can be repeated if necessary. The tension of the wire is monitored as the tool is retracted to verify correct insertion. If sufficient tension is not present, for example, if the pin did not lock into place, the robot is programmed to try the insertion again. Insertion is verified as illustrated in FIG. 12, through the gripping of the wire by the inner clamp means 51 and slight movement of the robot in a direction opposite the direction of insertion in order to verify that appropriate tension is present.

Once the insertion is verified, the tool routes the wire through the formboard layout as the wire is fed into the tools' opposite end. As can be seen in FIG. 6, this routing would take place from connector 157 past standoff 161, standoff 163 and to alignment fixture 133 adjacent connector 165. For illustrative purposes, a third alignment fixture 133 is shown adjacent connector 167. It should be appreciated that the actual disposition of the wires in the wire harness is one of manufacturing requirement and dictated by the application of the wire harness itself. Accordingly, any number of a variety of standoffs and connectors can be used in conjunction with the present gripper apparatus and the process and technique described herein. During the routing of the wire, the several collets are adjacent one another, defining the bore 69 and the internal clamp 51 is disengaged from the wire. The wire passes through the bore 69 (FIG. 1) as it exits the tensioning and centering device 87. Wire tension is monitored during the routing to detect snagging or tangling. When the proper laying of the wire is complete, its second end connector pin P of the wire W is automatically loaded as the wire is pulled through the bore 69 and seats in the collet pins 63 and 63'.

Figure 14:
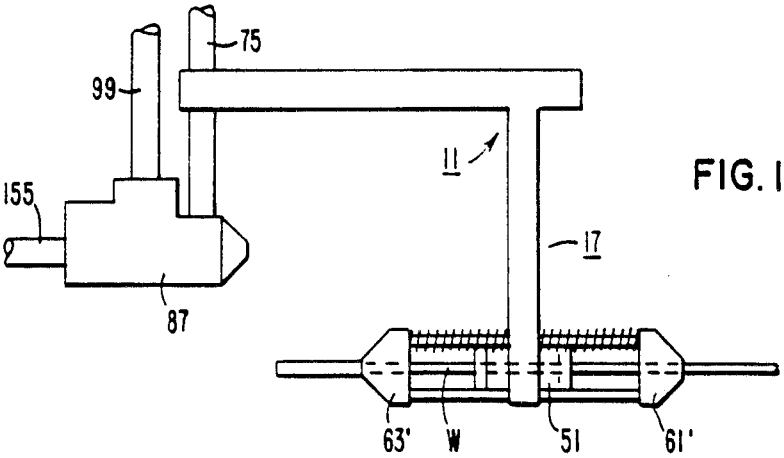
FIG. 14 is a schematical elevational view of the loading of the wire pin into the second end of the robot gripper.

Turning to FIG. 14, the loading at the second end is also detected by force sensing. When the shoulder S of the contact pin P reaches the collet pair 63 and 63' of the assembly tool 17, the tension in the wire increases and the strain gauges of the robot hand indicate that the contact is loaded. Once this is so detected by the strain gauges, it is also clear that the second end of the wire is free of the tensioning and centering device 87. As a result, the pressure in the several cylinders 73 and 75 by which the tensioning and centering device 87 is maintained in a downwardly extended position is removed and the tensioning and centering device is spring biased into a second or upper position. With the tensioning and centering device in its second, upward position, the second end or back end of the assembly tool defined by the collet pin 63 and 63' now has access to both the alignment fixture 133 and the connector 165 adjacent thereto. As described above in detail, the robot gripper runs the protruding pin P of the second end of the wire into the alignment fixture for repositioning if necessary. The wire is now ready for insertion into the second connector. The movements required for the insertion into the second connector are similar to the movements required for the insertion into the first connector. It should be noted that any number of a variety of connectors can be utilized. If, however, the pin size is different and the force required for insertion are therefore different, the programmable robot system adjusts its force sensing strategy for this new situation. The pin is inserted and once again, there is a pull test after insertion to verify proper locking of the pin into the connector. Reference may be had to the description in association with FIGS. 9, 10 and 11 for details of the pin alignment and insertion procedures.

It should be appreciated that due to the complex nature of wire insertion in automated high density wire harness assembly, it is necessary to integrate sensors into the assembly tooling. Such an integration of sensors is known and is available in many commercial robots, therefore the operation of strain gauges will not be discussed in detail herein. Typically, strain gauges are utilized to provide the sensor input necessary for such assembly. As a result, force monitoring is used in insertion and wire routing. Forces are monitored by a computer through the use of strain gauges. The strain gauges output or force is represented in a program as a variable which is accessible at any time in order to determine the forces being applied to the gripper. Before insertion, the forces on the terminating end are monitored as the gripper approaches the connector to assure that the path is clear. Force feedback would indicate an obstruction, causing the robot to generate a new path and retry the insertion. During insertion, force feedback is used in conjunction with position feedback to determine when the pin has bottomed out into a connector. When a predetermined increase in force is indicated, the position is checked, to determine if the pin is seated properly in the connector. After insertion, the gripper retracts and strains the wire. The force is checked once again. No force indicates that the pin hasn't locked into the connector and the insertion would thus be retried with a new path. If proper force is sensed, the assembly is continued. In order to complete the assembly, that is, to insert the second end of the wire, the second terminated end must be located. The gripper moves on axis with the wire until the force increases, indicating that the second termination is in the gripper and is ready for final insertion. The aforedescribed sensor based assembly increases the reliability of the insertions by providing a method for error recovery and also provides a valuable tool for locating the end of the wire in preparation to the loading of the second end of the wire and to the second end of the wire insertion gripper. Such strain gauges can be incorporated into a compliant wrist or a robot hand which would grip and actuate the end effector described herein. Such wrists and hands are commercially available and the use of strain gauges to monitor the movement of the wrists and hands is well known to those skilled in the art of automated manufacturing.

DESCRIPTION OF WIRE PREPARATION SYSTEM

Figure 16:
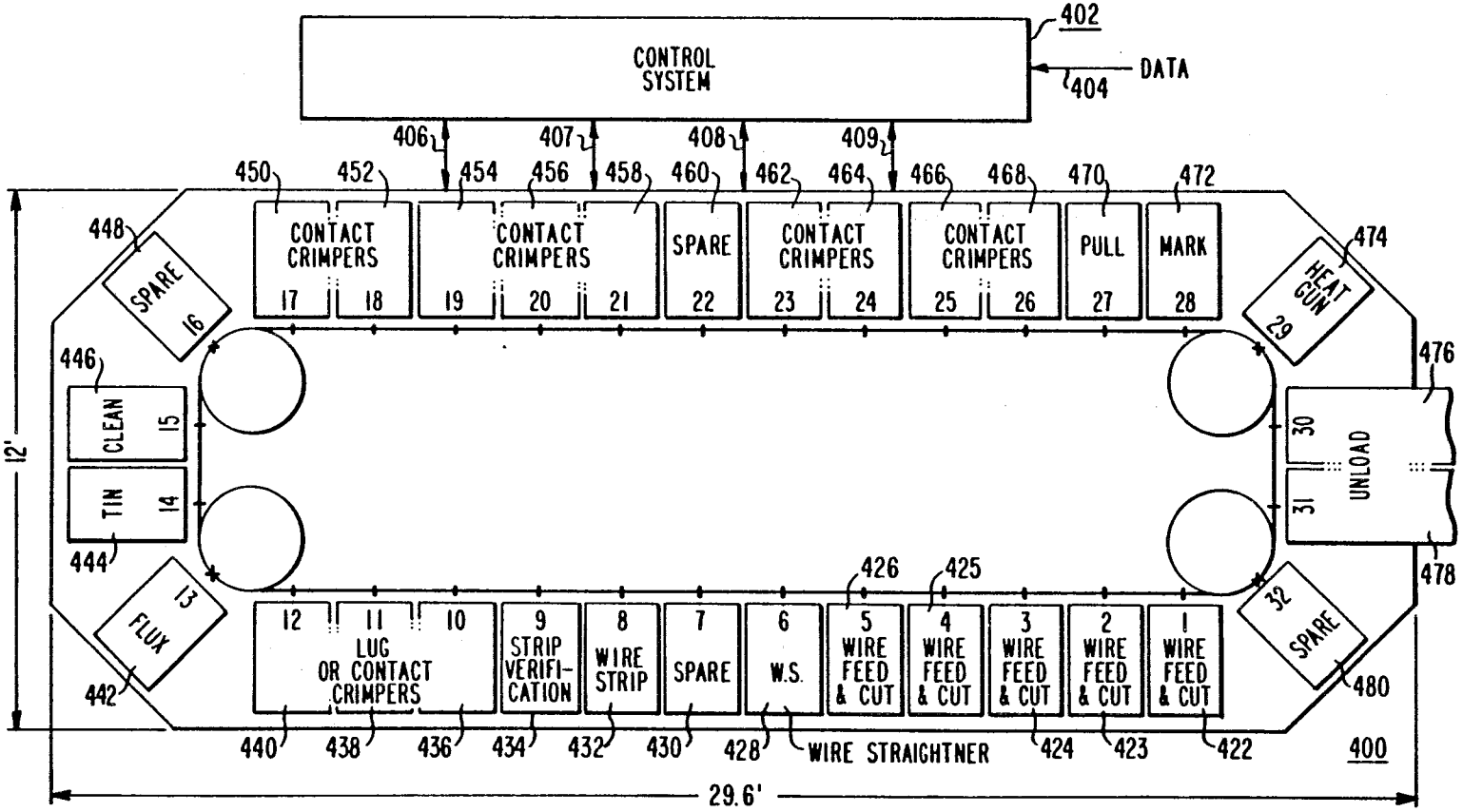
FIG. 16 is a somewhat schematic top view of apparatus comprising the invention.
Figure 17:
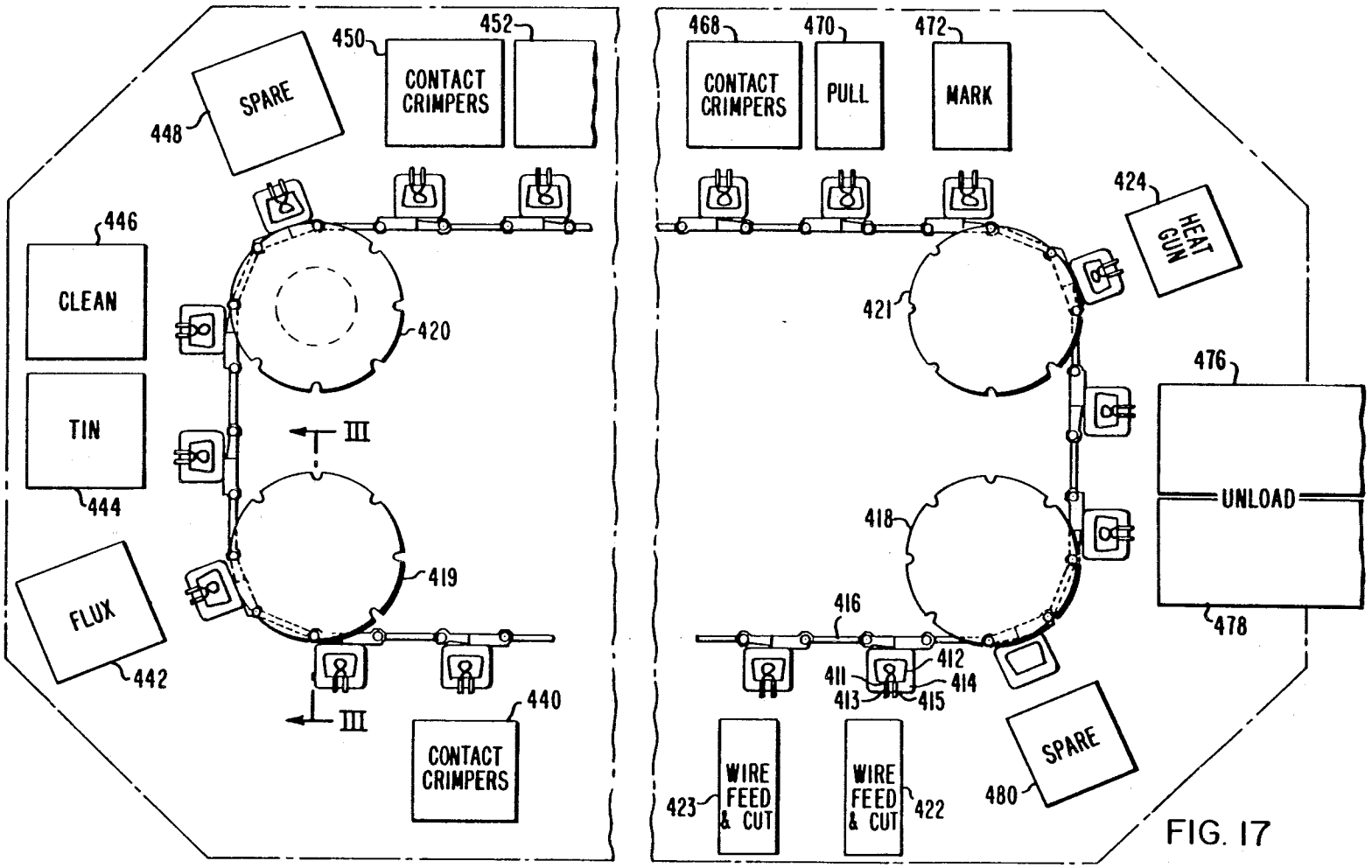
FIG. 17 is a top view of the apparatus comprising the invention showing more detail of the transport apparatus.

The wire preparation system 400 of the present invention is seen schematically in FIGS. 16 and 17, along with control system 402. This control system 402 is referred to as computer means 12 in FIG. 16, and that portion of the computer means 12 which controls the wire preparation system will hereafter be referred to as control system 402. Control system 402 can be a separate computing means from that used to control the cable hardness assembly system, but in each case the manufacturing and design data base serves the control system or systems for both the wire preparation system and the cable harness assembly system. Manufacturing data regarding the wires to be prepared, in batch fashion or in sequence for forming a kit for a cable harness, is fed on line 404 to the control system 402 which is operatively connected to the wire preparation system 400. The control system can be a plurality of microprocessors or a general purpose computing means, which provides control signals along lines 406–409 for controlling and actuating the wire preparation system and the individual workstations that form it.

The purpose of the wire preparation system is to cut wire of selected diameter to a predetermined length, and thereafter, advance the wire along the system to the various workstations, and prepare the wire with selected electrical terminations and with identification markings thereon. The prepared wires are then ready for cable harness fabrication as described in copending application Ser. No. 670,526, filed 11-13-84 now U.S. Pat. No. 4,607,430.

The initial workstation is depicted at the lower right corner of FIGS. 16 and 17, with the wire preparation system having a generally rectangular layout with the sequential workstations spaced about the periphery. The generally rectangular central work area includes a workpiece table 410.

The wire preparation system functions in the following way; the cut to length wire 411 (FIG. 17) is placed into a wire container 412 which is in turn mounted on a transport pallet 414 which is advancable around the central work area by means of an endless chain means 416 and plural sprockets 418, 419, 420 and 421. The wire transport pallet is advanced from workstation to workstation disposed about the central work area, and a specific wire preparation operation is performed at each workstation, with a pallet for each workstation. In the embodiment of FIG. 16, 32 workstations are shown.

Figure 18:
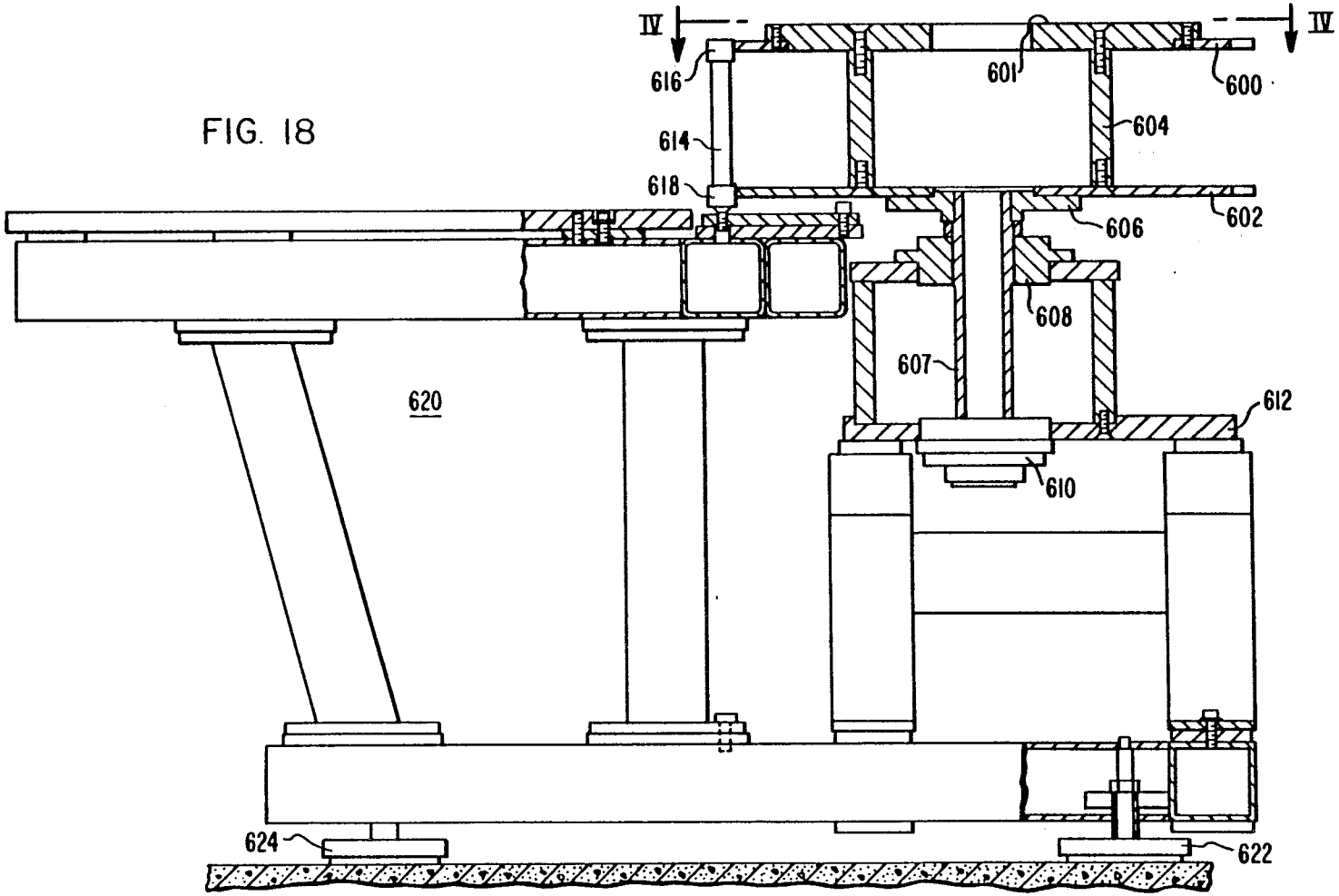
FIG. 18 is a cross-section of the sprockets supporting the transport chain.
Figure 19:
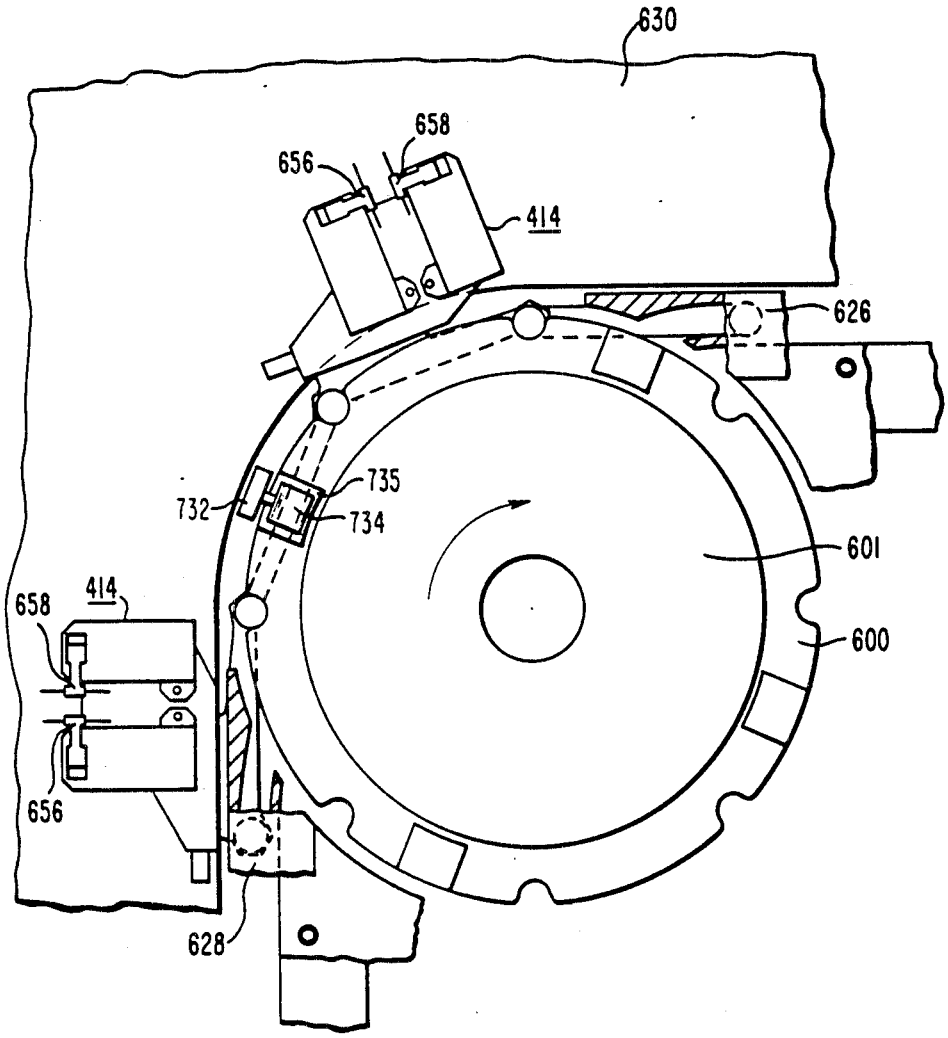
FIG. 19 is a top view of the sprockets including wire transport pallets attached thereto.

A plurality of pallets, with a typical wire transport pallet illustrated at reference numeral 414, are mounted on chain 416 which is advanced by drive sprocket members 418, 419, 420 and 421 disposed in each corner of the generally rectangular central area 410 as is illustrated in FIG. 17. The container 412 mounted on each pallet holds a single wire with both terminal ends extending from the container. The details of the wire transport pallets and wire containers are seen in greater detail in FIGS. 20, 21 and 22, while details of the drive means are seen in FIGS. 18 and 19.

The initial workstation is seen in FIGS. 16 and 17 at the lower right corner and is a wire feed and cut station 422. A plurality of such wire feed and cut stations 422–426 are depicted to permit feeding wires of different diameter as required. These wire feed and cut stations are seen in greater detail in FIGS. 32 and 33. A single wire 411 of predetermined diameter is fed from station 422 into wire container 420 with the terminal ends 413, 415 of the wire supported in first and second wire clamps and extending from the clamps a predetermined distance in generally parallel relationship to each other toward the workstation as depicted generally in FIG. 17.

The wire transport pallet with wire loaded in the wire container is supported and advanced to wire straightening workstation 428, where the extending terminal ends of the wire protruding from the wire clamps are straightened and spaced a predetermined distance apart for presentment of the wire ends to the succeeding workstations. This wire straighening workstation 428 is seen in greater detail in FIG. 40.

A spare workstation 430 is seen in FIG. 16 after the wire straightening station 428, with the wire strip workstation 432 disposed adjacent as the next operating workstation. This strip station 432 functions to strip electrical insulation from a predetermined length at the extending terminal ends of the wire. The next workstation is a wire strip verification station 434 which senses whether the insulation has in fact been removed from the wire terminal ends 39 generating and analyzing a TV image of terminal portions 413 and 415 of wire 412.

At the wire strip station 432, the ends 413 and 415 of the wire 412 are sequentially stripped. The first lead 413 is positioned in front of the stripper and the wire support clamp holding this lead moves outwardly inserting the lead 413 into the stripper workstation 432 where the stripping operation is performed. Horizontal indexing means included in the wire transport pallet indexes the wire left positioning terminal end 415 in front of the stripper 434 and the above described cycle is repeated for the second lead.

If it is determined the wire 412 has been stripped properly, the wire transport pallet holding this wire is advanced to the next operation wire preparation workstation. If the stripping operation has not been properly carried out, a signal is sent to control system 402 to ensure that the pallet with the improperly stripped wire is advanced around to the unload station without attempting further wire preparation operations or an operator can intercede and complete the stripping operation.

The other workstations that are next in line may or may not be used depending on the type of wire termination which is to be placed on each wire end. The control system keeps track of which wire is at each workstation and provides control signals to the appropriate workstation to ensure that the proper wire preparation operation and wire termination is provided. The wire terminations may be a pin contact which is insertable into an electrical connector, a terminal lug of the eyelet or U-shaped variety, or any variety of special termination means.

In FIGS. 16 and 17, the wire preparation system is seen with a layout of 32 workstation spaces, and workstations numbered 436 through 468 are dedicated to specific operations for mounting electrical terminations on the wires. Workstations 436, 438 and 440 are lug or contact mounting and crimping stations. Station 442 is a soldering flux application workstation, and station 444 is a solder tinning workstation where solder is applied to wire ends to which soldering flux was applied at flux station 442. Station 446 is a cleaning station for removing excess soldering flux from the solder tinned wire ends. Station 448 is a spare station. Stations 450 and 452 are contact mounting and crimping workstations for different electrical terminations than stations 436–440. Stations 454, 456 and 458 are still other contact mounting and crimping stations. Station 460 is a spare station, while stations 462, 464, 466 and 468 are yet other contact crimping stations. These workstations 436–468 are directed to the mounting and securing of the desired wire termination on the desired wire terminal ends. The control system ensures that the proper termination is made for each wire terminal end, following the cable harness and wire preparation design and manufacturing data.

Each wire transported in a wire container upon an individual wire transport pallet then advances to the pull test workstation 470 at which station the integrity of the electrical termination or contact on each end of the wire is tested. The wire is grasped above the termination and also the termination is engaged and pulled along the direction of wire extension to ensure that there is secure mechanical and electrical engagement between the termination and the wire end. This wire pull workstation 470 can be seen in greater detail in FIG. 42.

Figure 43:
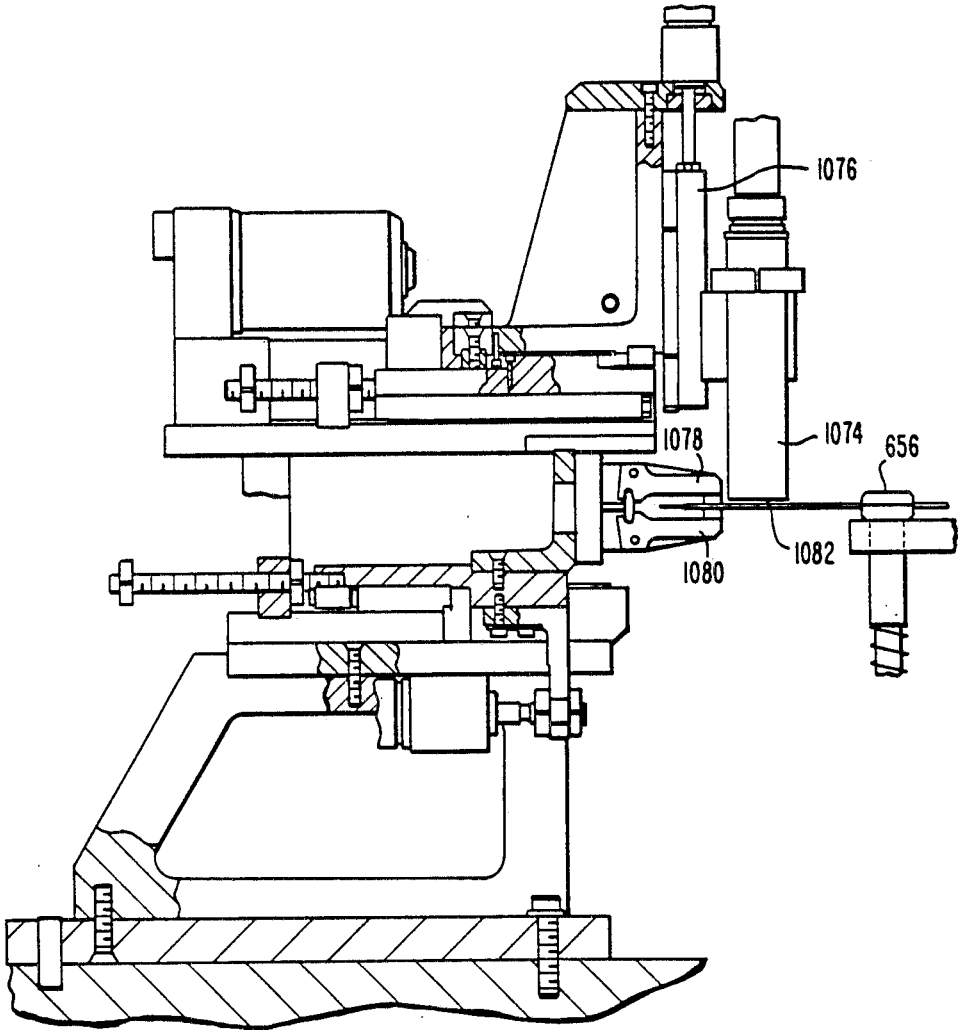
FIG. 43 is a side view of the wire marking workstation.

The wire is then advanced to an inkjet marking station 472 which is seen in greater detail in FIG. 43. Identification markings are sprayed onto the wire insulation near each of the wire terminal ends. The identification marking is controlled as are all workstations by control system 402, and the identification code for each wire end is determined by the cable harness design and manufacturing data. The inkjet marked wire is then advanced to the ink drying workstation 474 which applies heat to dry the ink and complete wire identification marking.

In the embodiment of FIG. 16, two wire unloading workstations 476, 478 are depicted with another spare workstation 480 completing the 32 workstations. At the wire unload stations the wires which have been fabricated in moving around the wire preparation system are removed from the system, and may be directly transported to a cable harness assembly system, such as taught in copending application Ser. No. 670,526, filed 11-13-84, now U.S. Pat. No. 4,607,430. This transport may be by way of a simple robot arm with end effector which engages at least one end of the terminated wire and removes it from the wire container and feeds it directly to the cable harness assembly system. The wires may be retained in the wire containers, and the containers may be off-loaded and either transported, stored, or directly fed into another cable harness assembly system. The robot arm end effector may engage both of the terminated ends of the wire for unloading the wire from the wire container, and either feed one wire end directly to a cable harness assembly system or feed the wire to storage means for later use.

Of course the number of workstations can be varied as can be the functions of the specific workstations in carrying out the purpose of the wire preparation system.

FIG. 17 illustrates the wire transport pallets, and the chain and sprocket drive system for advancing the pallets about the wire preparation system. The two wire terminal ends are seen extending toward the respective workstation with which the wire transport pallet is aligned. At each workstation, the wire transport pallet can be activated by the control system to advance the wire terminal ends toward the workstation singularly or together and index the wire terminals longitudinally a predetermined distance to present the terminal ends of the wire to individual workstations in a standardized manner for purposes of performing wire preparation tasks.

Although the operation of the system was described above with reference to a single wire being processed, it will be appreciated, that each workstation is capable of performing its assigned wire preparation task independently of all other station. That is to say, that at a particular time, a wire requiring a wire preparation task may be positioned at a plurality of workstations. In which case, the control system 402 will initiate all station required to perform a wire preparation task and inhibit indexing of the transport system until all of the workstations have completed their task. Stated another way, at any particular time the workstation having the longest cycle time controls the indexing interval.

FIG. 18 is a drawing partially in cross section illustrating one of the sprockets for supporting the drive chain and its relationship to the main support table (structure) 620 as illustrated in top view in FIG. 17. The sprockets includes top and bottom section with the top section consisting of an inner circular member 601 and an outer ring member 600. The bottom section consists of a single circular member 602 with the top and bottom sections spaced apart by a cylindrical spacer 604. The two sections of the sprocket are secured to the spacer 604 using any convenient means such as screws.

The bottom member 602 of the sprocket is affixed to a flange member 606 which is affixed to a hollow shaft member 607. Upper and lower support bearings 608 and 610 suppor the hollow shaft member 607 with both of the support bearings ultimately being affixed to a support plate 612. Support plate 612 is in turn supported by the remainder of the table structure collectively illustrated at reference numeral 620. For convenience, the table structure 620 is provided with leveling devices illustrated at reference numerals 622 and 624.

The structure described above is essentially repeated at each of the drive sprockets illustrated in FIG. 17 with the exception that at one corner a motor is affixed to the support shaft 607 so that the chain transport mechanism can be driven, in indexed increments, around the path as illustrated in FIGS. 16 and 17. The control system 402 actuates the drive motor to incrementally position the wire transport pallets at each of the workstations where wire preparation functions are performed, as required.

FIG. 19 is a top view of the sprocket mechanism illustrated in FIG. 18, including a portion of the table top structure 630, around which the various workstations, are positioned and including portions of the guides 626 and 628 positioned along the straight edge of the system to provide support for the drive chain. The drive sprockets illustrated in FIGS. 18 and 19 have a diameter of approximately 3 feet with the links of the transport chain being in the neighborhood of 1 foot long. This results in a shortening of the effective path length around the sprockets due to the fact that the chain does not blend (conform) to the outer circular periphery of the sprocket. Instead, the links of the chain form straight line segments between notches in the sprocket 600. Without compensation for this phenomenon, the tension on the drive chain changes depending on the angular position of the drive sprockets. To compensate for this phenomenon, the channels 626 and 628 do not approach the drive sprocket 600 tangentially in a straight line. Instead, a short distance from the sprocket the drive channels curve inwardly and then outwardly, causing the drive pins of the chain to be deflected inwardly a short distance as the drive pins of the chain approach and depart from the sprocket. This tends to maintain the tension on the chain constant as the sprockets rotate to index the chain to position the wire transport pallets at the workstations.

Along the straight edges, the drive chain is vertically supported by vertical support rollers, a typical roller illustrated at reference numeral 734, which travel on the upper surface of the roller guides, 626 and 628. As the vertical support roller 737 approaches the sprocket 600, support is transferred from the top surface of the roller guide 628 to a support block 735 which is affixed to the upper surface of the ring member 600. A vertical support roller 735 is provided between each wire transport pallet 414 resulting in vertical support blocks 734 being provided between every other notch on ring member 600.

As previously explained, the function of the wire transport system is to transport pre-cut lengths of wire to various workstations in a standardized manner. More specifically, the wire transport pallets are affixed at equidistant locations to the transport chain, as illustrated in FIG. 19. Each of the wire transport pallets 414 includes first and second wire support clamps 656 and 658, with first and second ends 413 and 415 of the wire extending outwardly from the wire support clamps, 656 and 658. The wire extends outward from the wire support clamps, 656 and 658, and is coiled on the inside of a round container 649 (FIG. 20) having tapered edges. The wire holding clamps, 656 and 658, are affixed to first and second substantially rectangular plate members 660 and 662. The rectangular plate members 660 and 662 which are in turn affixed to two additional plates, which are not visible in FIG. 20, such that rectangular plate members 660 and 662 are free to slide forward independently; however, they are normally held in the retracted position first and second by coil springs, 661 and 663.

Figure 20:
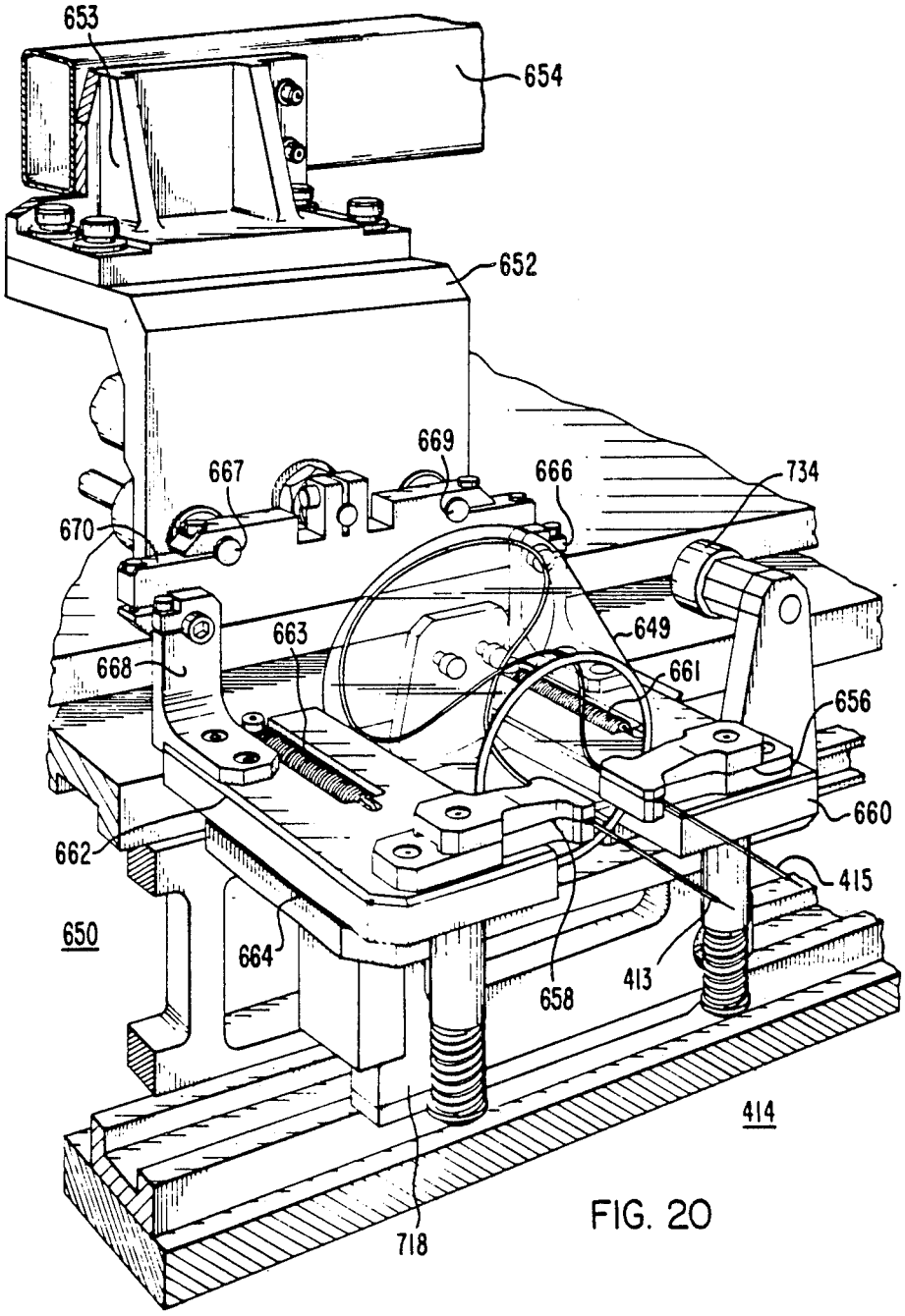
FIG. 20 is a pictorial view of the wire transport pallet.

Affixed to the ends of rectangular plate members 660 and 662, at the end opposite from the wire support clamps, 656 and 658, is two L-shaped push brackets, 666 and 668. A push bar 670 is slidably affixed to the support bracket 652 by two support rods, 667 and 669. An actuator pushes (not visible in this illustration) the push bar 670 forward, contacting push bracket 668 and 667 to push the wire holding clamps, 656 and 658, forward a predetermined amount. In FIG. 20, the length of the push bar 670 is selected such that it contacts both of the U-shaped push brackets, 666 and 668, such that both ends of the wire 413 and 415 are pushed forward a predetermined amount. When the ends of the wire are pushed forward, they are positioned such that a workstation can do a wire preparation task such as stripping or labeling the wire as subsequently explained. That is to say, all of the workstations are designed such that when a wire support pallet 414 having a wire positioned in the wire support clamps 658 and 660 is positioned in front of the workstation and the wire support clamps is in the forward position, the wire ends 413 and 415 will be within the working range of the workstation.

Figure 21:
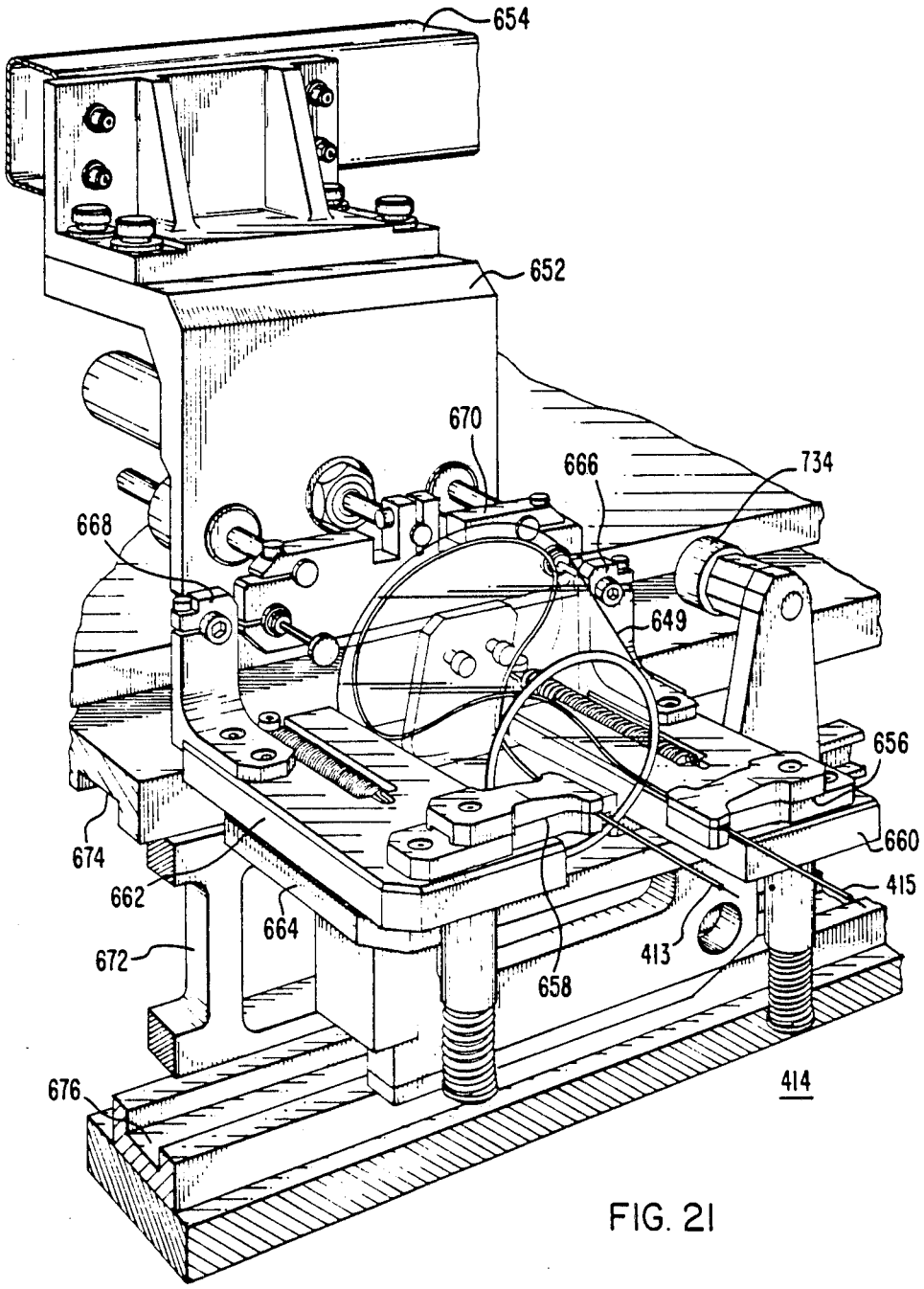
FIG. 21 is a pictorial view of the wire transport pallet with one of the wire clamps extended.

FIG. 21 illustrates an alternate arrangement for pushing the wire holding clamps, 656 and 658, forward to present the ends of the wires, 413 and 415, to the work various station. In this illustration, the length of the push bar 670 is selected to be less than the distance between the push clamps, 666 and 668. The clamp holding mechanism is then positioned such that the push bracket 666 affixed to the plate member 660 is in front of one of the ends of the push member 670. The second end is short and fails to contact the second push bracket 668 as the push bar 670 is pushed forward. Thus, it only moves the first end 415 of the wire to the forward position to be within the working range of one or more of the workstations. Alternatively, as subsequently explained and illustrated, the wire support clamps, 656 and 658, can be repositioned such that the second clamp member 658 is pushed forward. Thus, as illustrated in FIGS. 20 and 21, the wires are contained in a container 666 and transported between each of the workstations in a standardized manner with the functions of the individual workstations determining what wire preparation operations are to be performed and whether wire ends, 413 and 415, are individually or singularly presented to the workstation.

Figure 22:
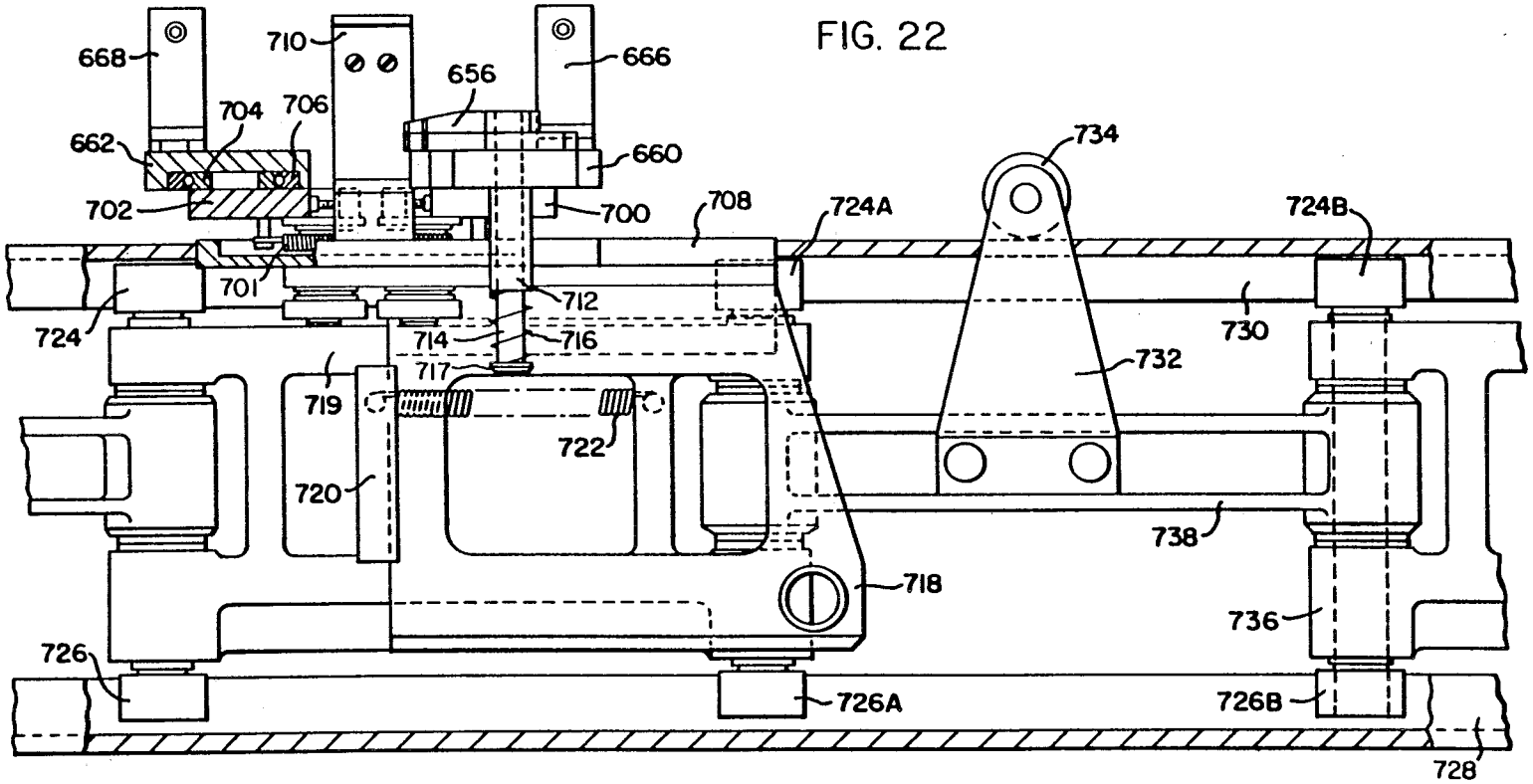
FIG. 22 is a front view illustrating the wire transport pallet, the transport chain and support track.
Figure 23:
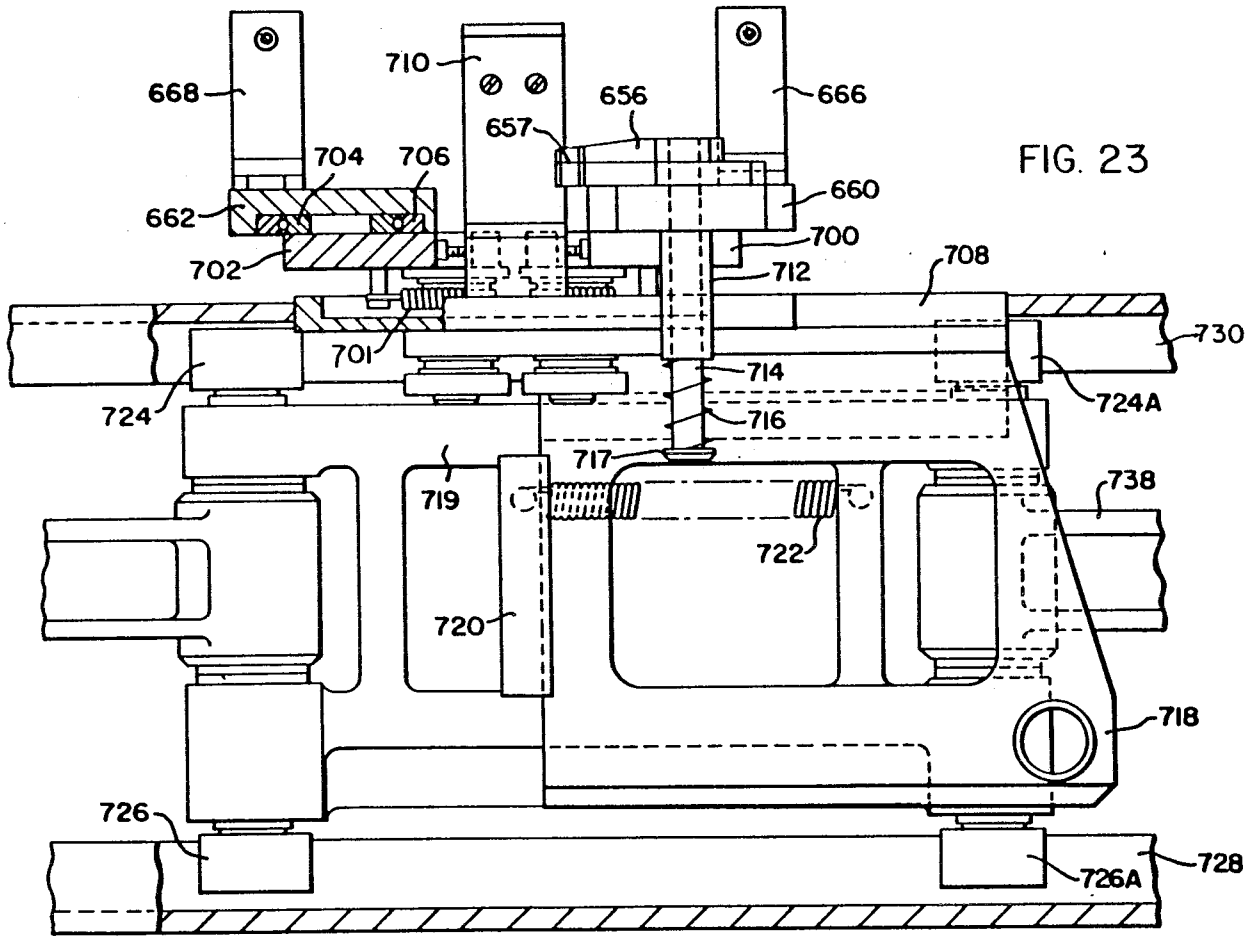
FIG. 23 is another front view of the wire transport pallet and the transport chain.

FIGS. 22 and 23 are front views of the wire support clamps, 660 and 662, along with the details of the supporting structures attaching these wire support clamps to the transport chain. FIGS. 22 and 23 differ primarily in the fact that in FIG. 22 additional portions of the transport chain is shown. More specifically, FIG. 22 illustrates two complete links of the transport chain while FIG. 23 includes one link and portions of two other links.

Wire support clamp 656 which is a mirror image of wire support clamp 662. Wire support clamp 656 includes top and bottom portions with grooves in these portions at the intersection to hold the wire ends positioned therein. The bottom portion of the wire holding clamp 656 is affixed to the top surface of the rectangular plate 660. The bottom portion of clamp 656 includes an opening therethrough through which a rod 714 extends and is affixed to the top portion of the wire support clamp 656. Concentric with the rod 714 is a cylindrical portion 712 which is affixed to the bottom portion of rectangular plate 660. A coil spring 716 surrounds the center rod portion 714 and rests on the bottom end of the cylindrical portion 712 and a flange portion 717 which is affixed to the bottom end of the rod portion 714. This spring normally retains the two portions of the clamp 656 together to support the wire end positioned in the groove. To open the clamp 656, a suitable pusher is provided to push upward on the flanged portion 717, as subsequently described in more detail.

The views illustrated in FIGS. 22 and 23 have been selected such that the second wire holding clamp 658 is not visible in order to illustrate the underlying structure. More specifically, the rectangular portion 662 is shown in cross section to illustrate that the bottom portion of the rectangular plate 662 includes a grooved portion. Positioned in the groove is two slide bearings, 704 and 706, with the inner portions of these bearings affixed to plate 702 and the upper portion affixed to the rectangular plate 662. This permits the rectangular plate 662 to be pushed forward to extend the wire support clamp 658 affixed thereto to position the wire held in the wire support clamp 658 to a workstation which is to perform a wire preparation operation. Similarly, plate member 660 is a mirror image of 662 and is similarly affixed to plate 700.

Although not shown in detail in FIGS. 22 and 23, rectangular plates 700 and 702 are affixed near the back inner corners to top bracket plate 708 such that they can rotate outwardly such that the distance between wire support clamps, 656 and 658, can be increased. Normally the clamps, 656 and 658, are held in the position illustrated in FIG. 22 by a coil spring 701 having its alternate ends attached to plates 700 and 702 near the front.

As discussed above, plates 700 and 702 are affixed to the top support plate 708 near their inner rear corners such that they can rotate. Top plate 708 is then affixed to a vertical plate 718 which is in turn slidably mounted to a first link 719 of the transport chain. A coil spring 722 having its alternate ends affixed to the link of the chain 719 and a spring bracket 720 holds the vertical support plate 718 in the rightmost position, as illustrated in FIGS. 22 and 23. The links of the chain are of two types with the types alternating as illustrated at reference numerals, 719 and 738, in FIG. 22. Each link of the chain is affixed to its adjacent link by a pin, with a typical pin being illustrated at reference numeral 736 in FIG. 22. The pins 736 attaching the links of the chain together extend through the links and have rollers, 724 and 726, attached to the alternate ends. Along the straight edges of the system, the rollers 724 and 726 travel in tracks to restrain the transport chain in a substantially vertical position and maintain it traveling in a straight line. Affixed to the center web of the link member 738 is a vertical bracket 732 which extends up and over the upper track 730 and includes a vertical support roller 734 which travels along the upper surface of the track 730. This bracket 732 and vertical support roller 734 supports the transport chain in a vertical direction to prevent sagging.

Figure 24:
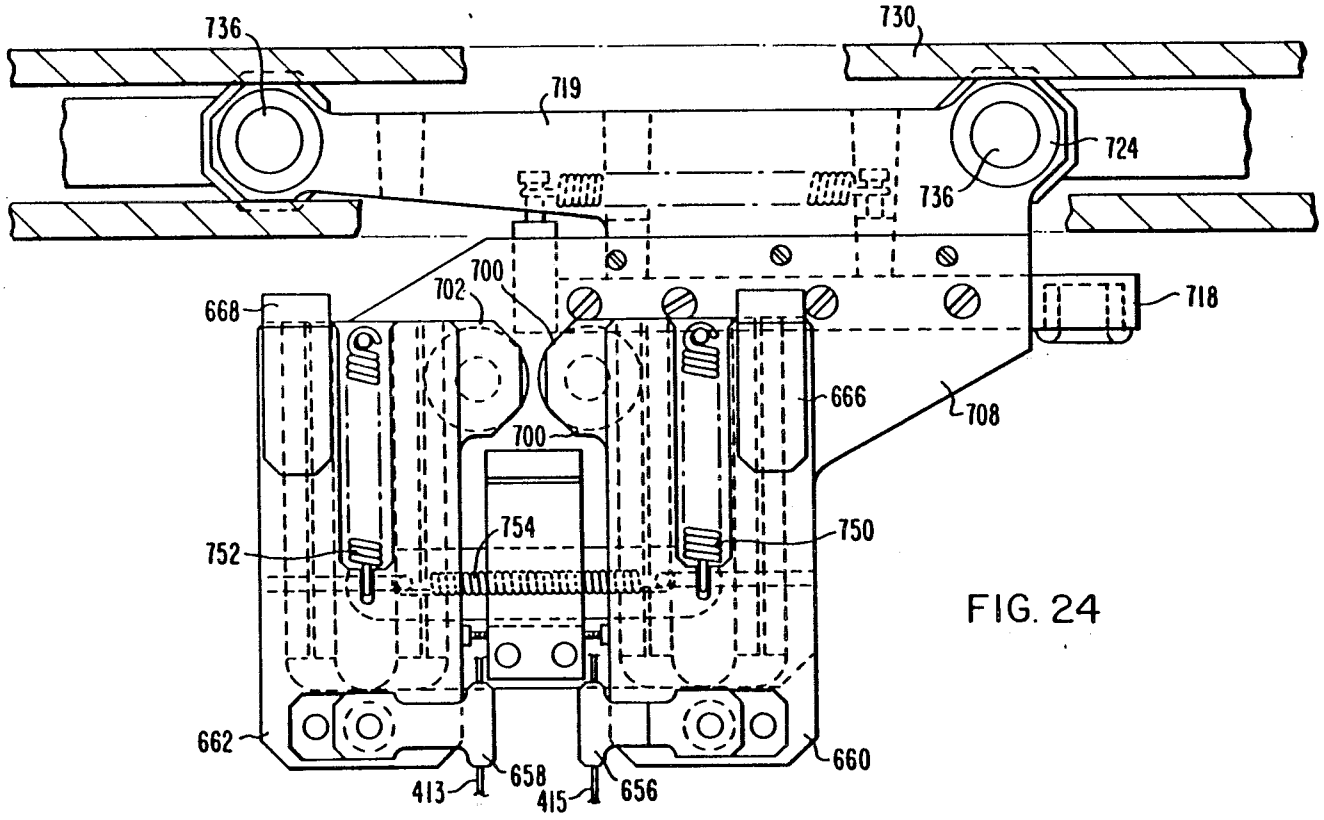
FIG. 24 is a top view of the apparatus illustrated in FIG. 23.

FIG. 24 is a top view of FIG. 23. As can be seen from this view, the rectangular plates 660 and 662 to which wire holding clamps, 656 and 658, are affixed is mounted above and slidably attached to plates 700 and 702. Two coil springs, 750 and 752, respectively have their alternate ends affixed to plates 660 and 662 and to plates 700 and 702. These springs 750 and 752 normally hold the wire support clamps, 656 and 658, in the positions as indicated in FIG. 24. As previously noted, plates 700 and 702 are rotatably mounted near their back inner corners and held in the inward position by a spring 754 attached near the front portion of these springs. For completeness of description the push brackets 666 and 668 are shown in top view affixed to the top plates 660 and 662. The vertical plate 718 is also attached to the support plate 708 with the entire assembly affixed slidably as previously discussed to link 719 of the transport chain. Typical, pins attaching the links of the transport chain are shown at reference numeral 736 with a typical vertical support roller positioned in the upper track 730 illustrated at reference numeral 734 (FIG. 22).

Figure 25:
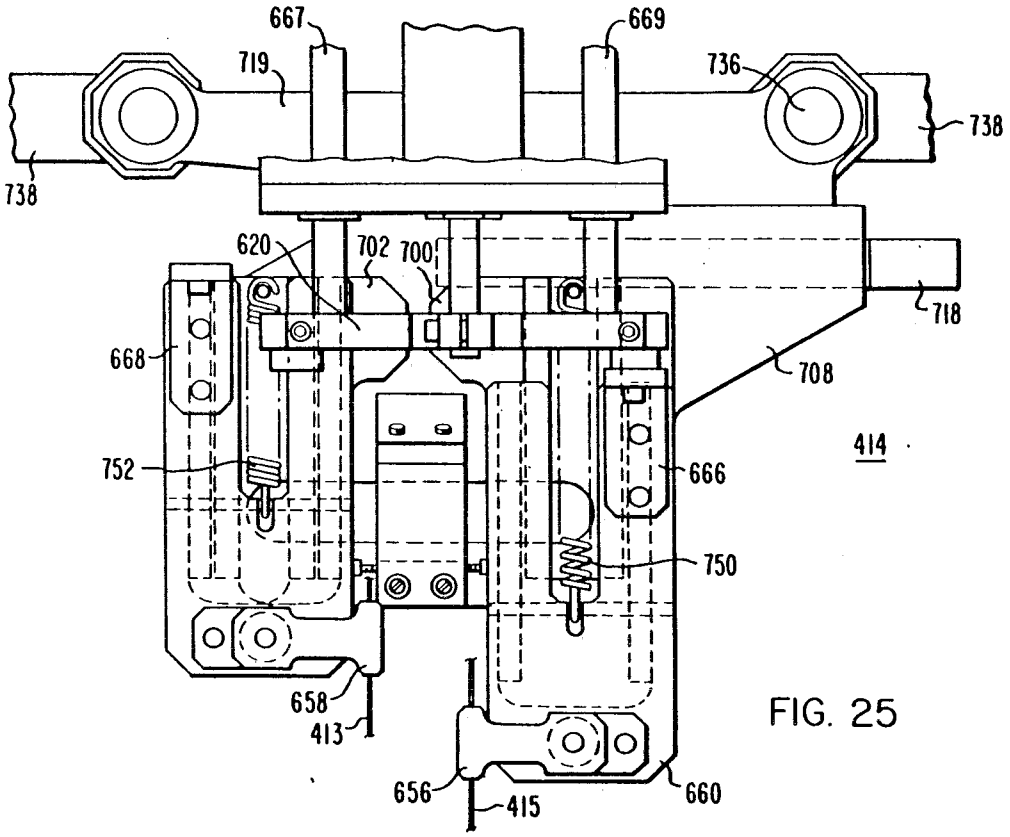
FIG. 25 is a top view of the apparatus illustrated in FIG. 24 with one of the wire clamps extended.

FIG. 25 is a top view of FIG. 24 with the right wire support clamp 656 extended. The extension of clamp 656 is accomplished by actuating the push rod 669 moving push plate 670 forward until it contacts the push bracket 666 moving the top plate 660 forward along its slidable mounts and extending retaining spring 750. Except for this extension, FIG. 25 is essentially the same figure as FIG. 24 and similar reference characters are used to identify the parts. This being the case, no further discussion of FIG. 25 is believed to be required.

Since wire support claim 658 is a mirror image of wire support clamp 656, it can be similarly extended by repositioning the wire transport pallet 414 horizontally, or subsequently described.

As previously discussed, the vertical support plate 718 and the wire support clamps, 656 and 658, affixed thereto can be moved horizontally to a position the wires, 413 and 415, held in the wire support clamps, 658 and 660, as desired. Plate 718, as previously discussed is slidably mounted on the chain link 719.

Figure 26:
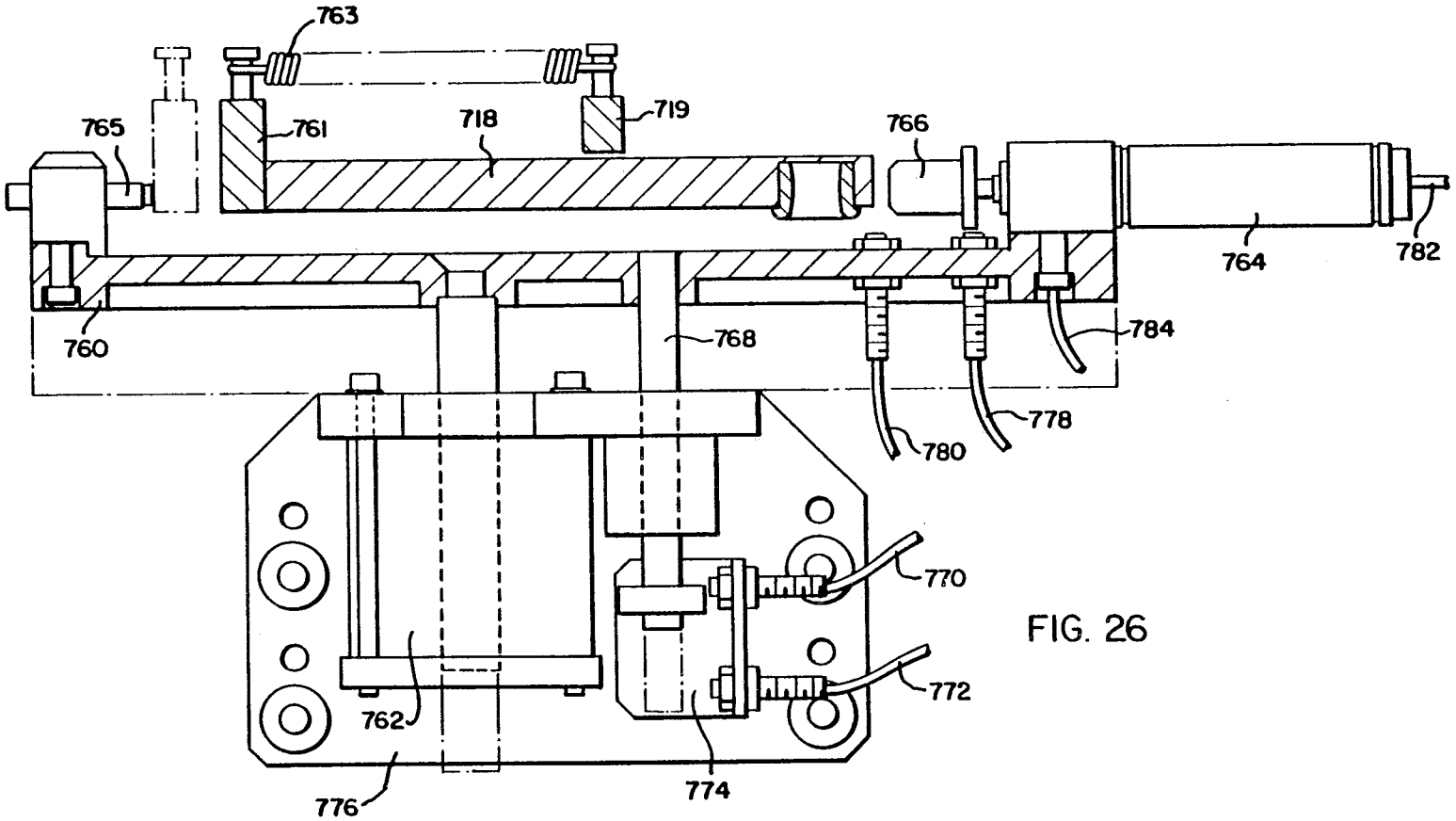
FIG. 26 is a top view of the horizontal translator for the wire transport pallet.

As previously discussed and further illustrated in FIG. 26, attached to the left end of the vertical plate 718 is a bracket 761 which extends backward and has the first end of a spring 763 affixed thereto. The second end of the spring 763 is affixed to the chain link 719 holding the plate 718 normally in the rightmost position. A horizontal translator which includes a bar 760 which has attached to its left end a stop 765. Affixed to the right end is a pneumatic cylinder 764 which includes a pusher 766 affixed to the end of the piston rod of the pneumatic cylinder 764. A support plate 776 has affixed thereto the pneumatic cylinder 762 which moves the bar 760 fore and aft such that in the forward position as shown in FIG. 26 the stop 765 extends to limit the leftward motion of the support plate 718 while the pusher 766 is in a position such that when the pneumatic cylinder 764 is actuated, the pusher 766 contacts the left end of plate 718 causing it to move in a leftward direction. Two sensors 778 and 780 respectively sense the two extremes of the motion of the pneumatic actuator 764 thus providing a signal indicating the position of the plate 718. Also support plate 718 includes a bracket 774 having two other sensors 770 and 772 attached thereto which detect the two extreme positions of the bar 760. Thus, apparatus is provided for pushing the support plate 718 and the wire support clamps, 658 and 660, affixed thereto between its two positions and for detecting these alternate positions.

Figure 27:
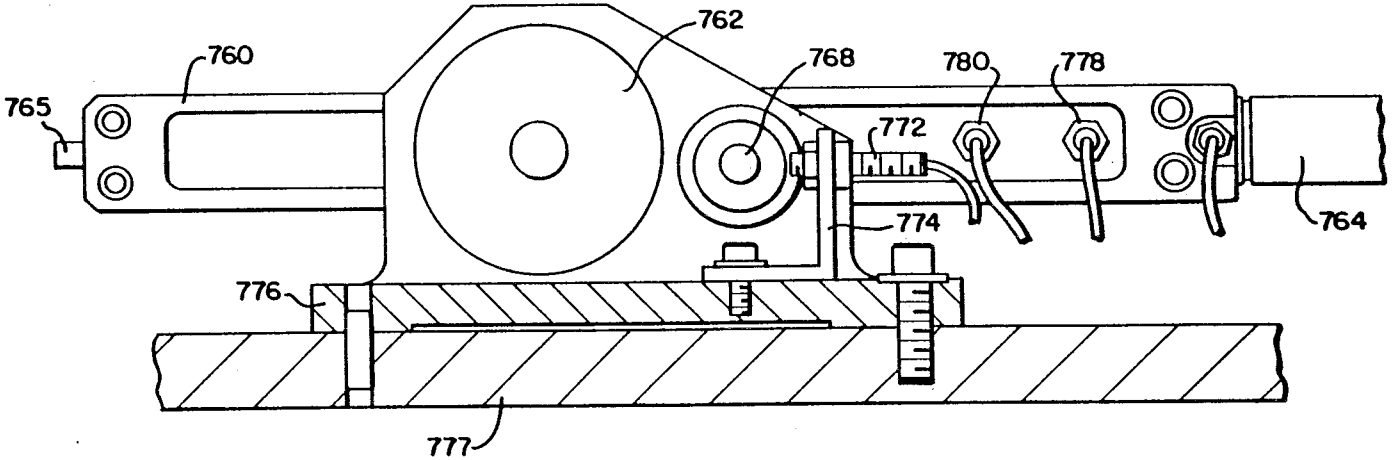
FIG. 27 is a front view of the horizontal translator for the wire transport pallet.

FIG. 27 is a front view of the apparatus illustrated in FIG. 26. This figure clearly illustrates that the support bracket 776 ultimately supports the bar 760 and the pneumatic cylinder 764 affixed thereto in a fixed position through attachment of the bracket member 776 to the table top 777 of the system. Thus, the pusher mechanism is retained in a fixed position while the drive chain transporting the wire support clamps 658 and 660 is also fixed by the drive chain indexing system. Thus actuating the pusher mechanism 764 moves the wire support clamps between their leftmost and rightmost positions for alternatively presenting wires 413 and 415 to the various apparatus for wire preparation tasks.

Figures 28, 29:
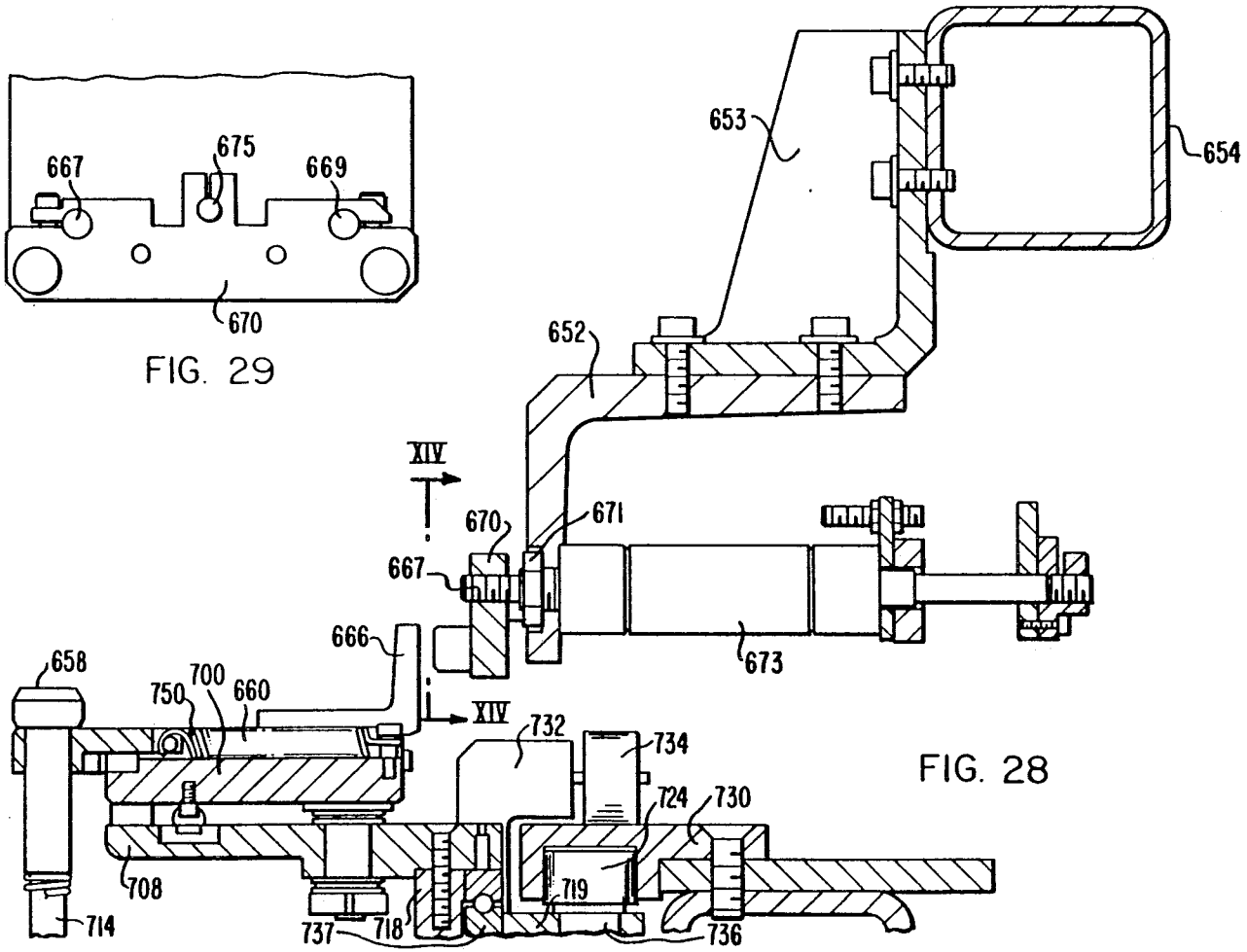
FIG. 28 is a side view of the wire support clamp and pusher.
FIG. 29 is a front view of the horizontal translator.

FIGS. 28 and 29 illustrate the relationship between the wire clamp pusher mechanisms and the wire support clamps 658 anbd 660. More specifically, in FIG. 28 the right wire support clamp 658 is illustrated in cross section. This clamp as previously discussed is affixed to the top plate 660. The spring 750 which is in turn affixed to the bottom plate 700 tends to retain plate 600 in the rightmost (in this illustration) position. Affixed to the top of plate 660 is the pusher bracket 666.

Structural member 654 is a part of the fixed (non movable) structure of the system. Affixed to this bracket is a second intermediate brackets 653 to which the pusher mechanism is affixed. Specifically, the pusher bar 670 is affixed to bracket 652 by two slide guide tofd 667 and 669. These guide rods are supported in the bracket 652 by two guide bushing mechanisms with the bushing for guide rod 669 illustrated at reference numeral 671. A pneumatic cylinder 673 includes a piston rod 675 which extends through bracket 652 and is affixed to the pusher bar 670. Thus actuating the pneumatic cylinder 673 causes the pusher bar 670 to move forward and contact the pusher brackets 666 to move the wire support clamps 658 and 660 to their forward position. Sensors are included to generate position signals which are coupled to control system 402 (FIG. 16).

Additionally in this view the guide track 730 for the roller 724 is also shown. The slide bearing mechanisms 737 which holds the plate 708 to the link of the chain 719 are also illustrated. Similarly, it is clear from this view that the bracket 732 extends inwardly and over the guide rail 730 such that the roller 734 rolls on the top of the guide channel 730 to retain the chain links in the affixed vertical position.

Figure 30:
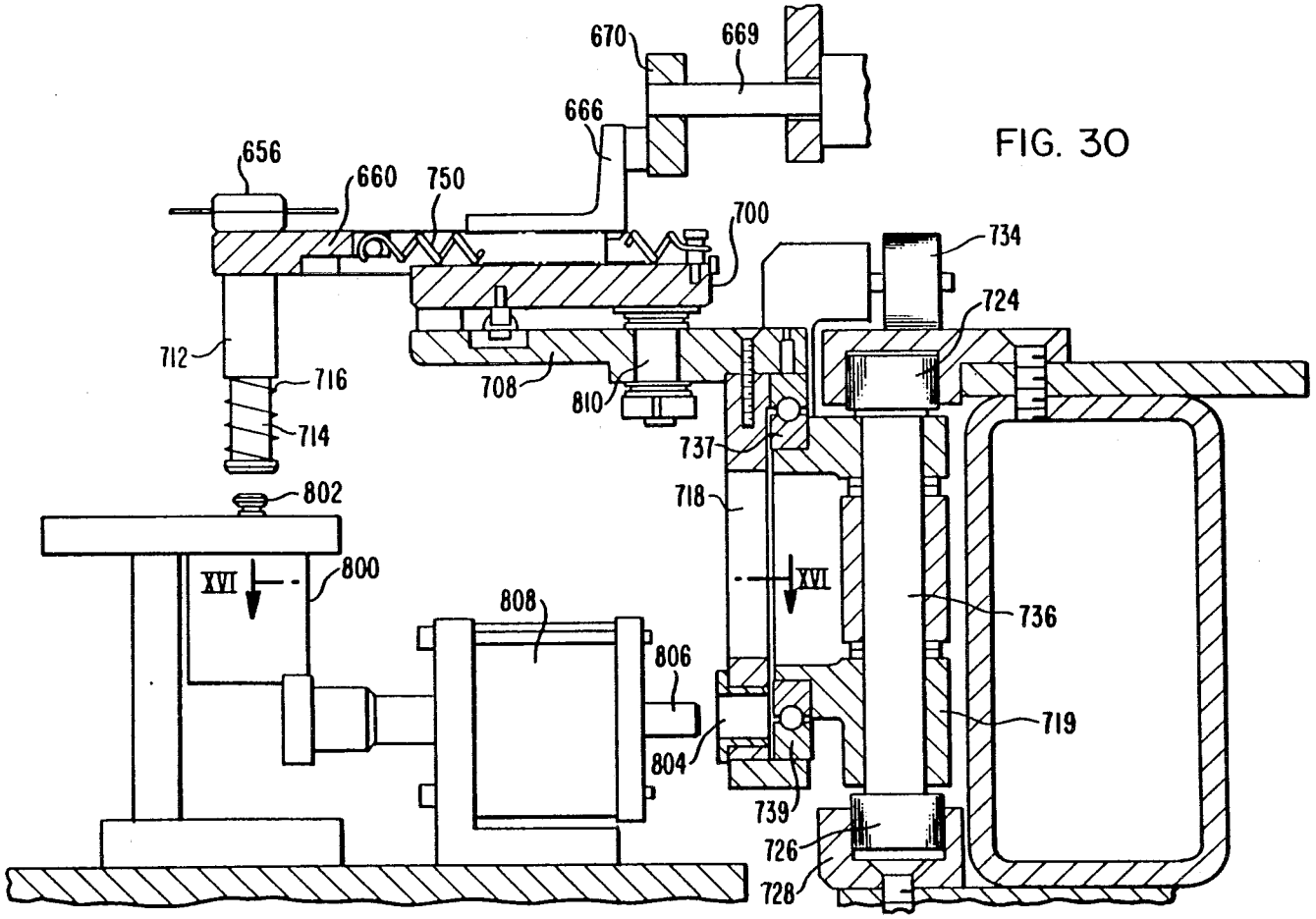
FIG. 30 is a cross-section of the wire support clamp and drive chain.

FIG. 30 is a more detailed view illustrating components of the transport chain, the clamp opening mechanism as well as the clamp pushers. More specifically, the wire support clamp 656 is shown in its forward or extended position. The pusher pneumatic cylinder 673 (FIG. 18) has been actuated to push the pusher bar 670 in its forward position. In this position the pusher bar 670 contacts the pusher bracket 666 and moves the top plate 660 to its forward position. This causes the coil spring 750 to be extended as shown.

As in previous illustrations, it is clear that the top plate 660 is affixed slidably to the underlying plate 700. Plate 700 is then affixed to plate 708 by a pin and bearing mechanism 810 which permits the plate 700 to rotate with respect to the support plate 708. This feature will be subsequently discussed in more detail.

Additionally in this view the wire support clamp 656 opening cylinder 800 is illustrated. This is a pneumatic cylinder having a plunger 802 which is positioned to contact the bottom end of push rod 714. This push rod is in turn connected to the top portion of wire clamp 656, as previously discussed and illustrated. When the pneumatic cylinder 800 is actuated causing its plunger to move up, coil spring 714 is compressed, causing the top portion of clamp 656 to be moved upward, thus opening the wire support clamp 656.

The wire support clamps, 656 and 658, are operated in a standardized manner at each position where opening of the clamps is required to perform the required wire preparation function. Thus, a pneumatic cylinder of the type illustrated at reference numerals 800 is positioned at each workstation requiring wire support clamps to be opened. Position sensors are included to generate position signals which are coupled to control system 402 (FIG. 16) to indicate which clamps are open and closed.

At selected workstation positions it is necessary to provide indexing means which secures the wire support clamps more accurately with respect to the workstation than is conveniently provided by the main drive indexing mechanism for the transport chain. For example, the wire feed and cut workstations require accurate horizontal and vertical positioning. Such accurate horizontal indexing is provided by including in the vertical plate 718, an indexing hole 804. After the transport chain has been indexed to the selected workstation, a pneumatic cylinder 808 which is affixed to the main structure of the system is actuated, causing a positioning pin 806 to extend into the hole 808, causing the entire wire transport pallet to be positioned accurately in a horizontal direction.

FIG. 30 also provides a good illustration of how the sliding bearing mechanism 737 and 739 are positioned between the plate 718 and the link off the chain 719 to provide a mechanism for positioning the entire mechanism horizontally with respect to the chain link, as previously described.

Figure 31:
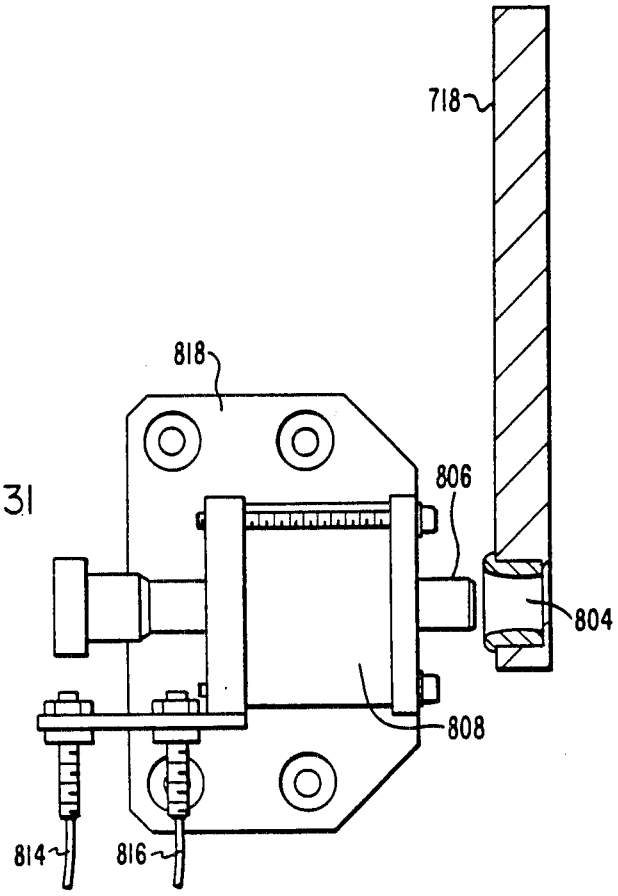
FIG. 31 is a top view illustrating the horizontal indexing pin.

FIG. 31 is a top view of portions of FIG. 30 illustrating the positioning of the indexing mechanism with respect to the vertical plate 718. This view clearly illustrates that the actuating cylinder 808 is affixed to a bracket 818 which is in turn affixed to the structure of the system. Two sensors 814 and 816 (not illustrated in FIG. 30) are included to detect the two positions of the position pin 806 and couple signals indication of these positions to the control systems 402 (FIG. 16). More specifically, sensor 816 indicates when the pin is inserted while 814 illustrates when the pin is withdrawn. Thus, by actuating the position pin, the wire holding clamps can be very accurately positioned in a horizontal direction.

The horizontal indexing mechanism illustrated in FIGS. 30 and 31 is also generic in that it can be positioned at any workstation which require this function.

Figure 32:
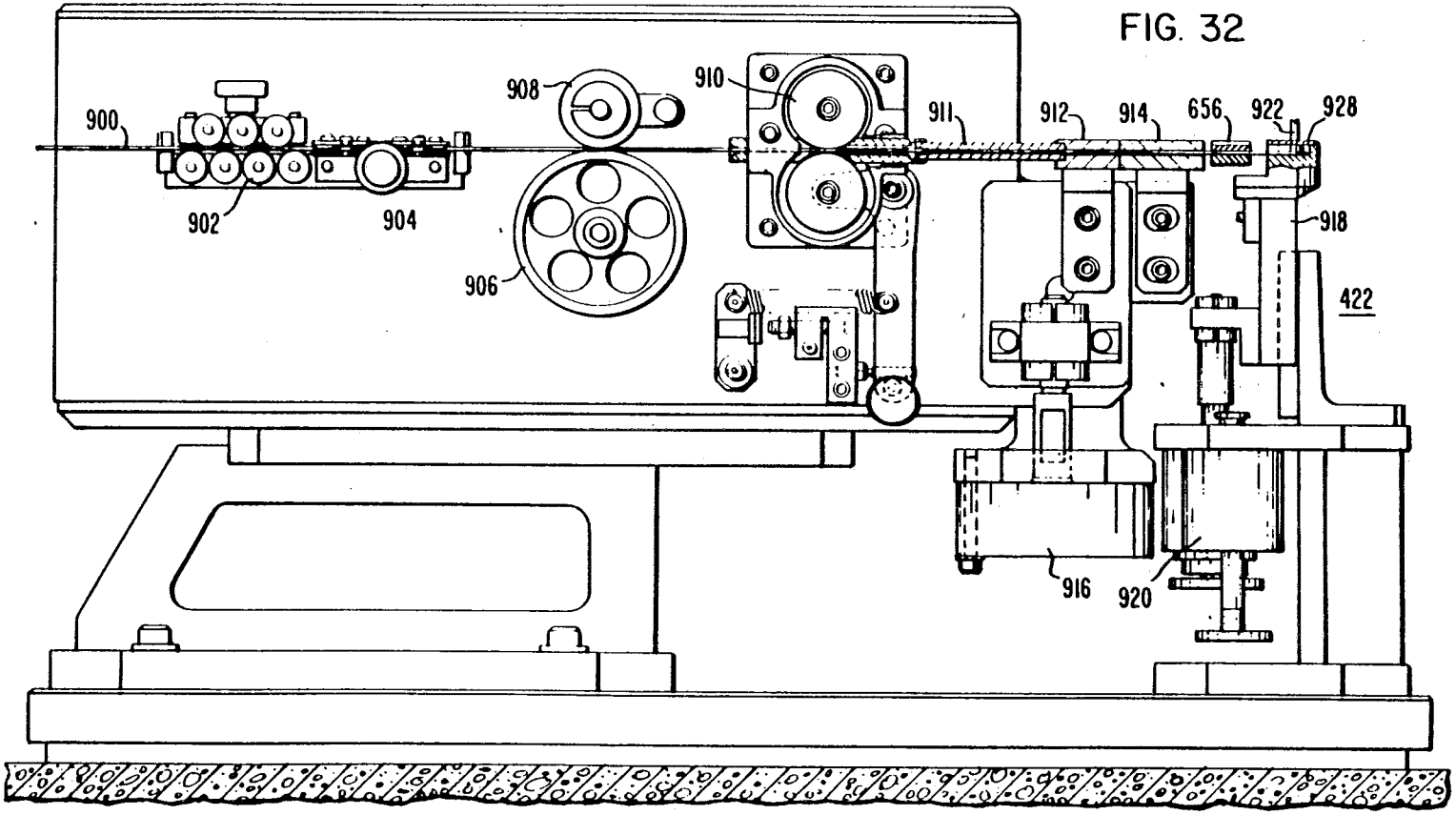
FIG. 32 is a side view of the wire feed workstation.

FIG. 32 is a side view of the wire feed and cut workstation 422 which is designed to feed wires in the wire transport pallet 414 described above. More specifically, the wire 900 to be fed to the wire transport pallet 414 is normally stored on a roll, not illustrated. The wire 900 first passes through two pairs of orthogonally positioned straightening rollers 902 and 904. After passing through the straightening rollers, 902 and 904, the wire 900 passes through a measuring device comprising a wheel 906 having a known diameter and a rotational encoder affixed thereto and a tension wheel 908 which holds the wire 900 against the wheel 906. After passing through the measuring wheels, the wire 900 passes through two drive wheels 910 which rotate to push the wire 900 through two shear blocks 912 and 914, through the opened clamp 756, through a wire turnaround mechanism 918 and back through the shear blocks 914 and 912 a second time. The wire turnaround mechanism includes upper and lower sections respectively movable in upward and downward directions. After the wire has been threaded through the shear blocks, 912 and 914 pneumatic cylinder 920 is actuated to lower the bottom portion of the wire turnaround 918. The top plate (section) is provided with suitable mechanisms to move this plate upward. After, top and bottom section of the wire turnaround mechanisms have been lowered and raised as discussed above, one of the wire support clamps is closed to grip the wire while the other wire support clamp 658 is opened. The wire feed drive mechanism 910 is energized to feed the proper length of wire into the wire transport pallet 414. One this has been accomplished, both of the wire wire support clamps, 656 and 658, are closed and pneumatic cylinder 916 is actuated, causing the shear block 912 to move upward, shearing the wire 900 at the intersection of these two blocks. To provide guidance for the wire between the drive mechanisms 910 and the shear block 914, a flexible tube is provided through which the wire 900 travels.

Figure 33:
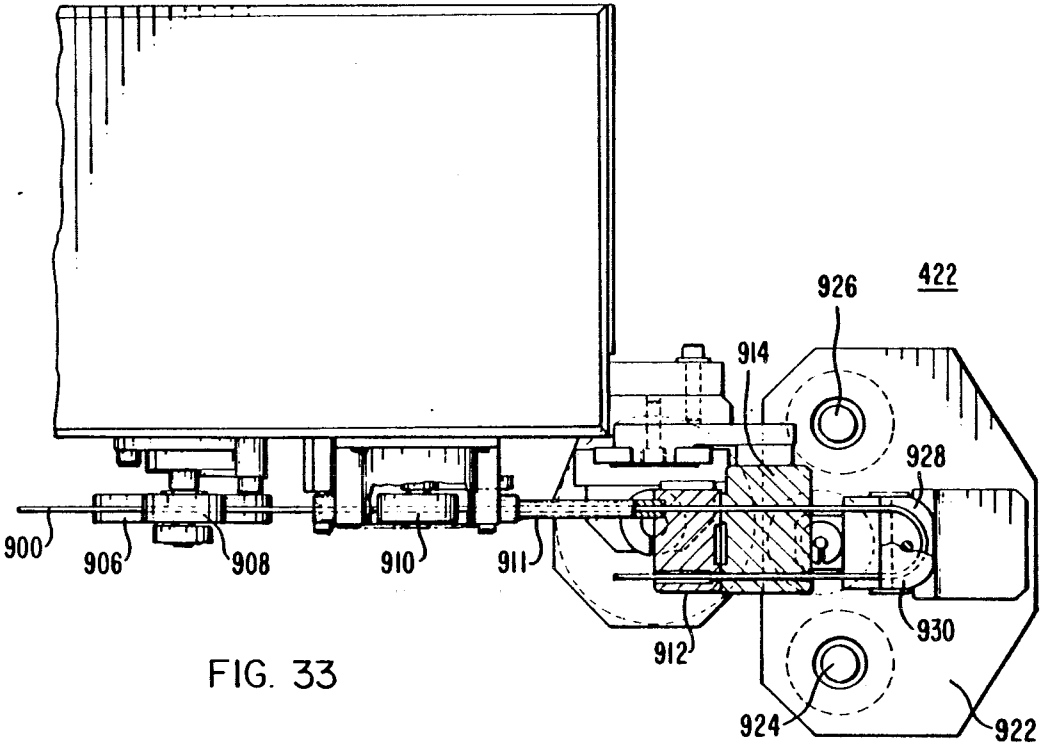
FIG. 33 is a top view of the wire feed workstation and wire turnaround.

FIG. 33 is a top view of the wire feed and cut workstation 422 and wire turnaround apparatus. In addition to the various components of this system previously discussed with respect to FIG. 32, from the this illustration the curved grooves in the bottom section 928 of the wire turnaround and the overlapping top plate 930 are clearly visible. Additionally, the U-shaped turn in the wire 900 as it is pushed by the feeder rolls 910 through the shear blocks 912 and 914 as well as through the groove in the wire turnaround apparatus are clearly visible. Additionally, two plungers 924 and 926 operated by pneumatic cylinders for opening the wire clamps as required in the wire loading operation are illustrated.

Figure 35:
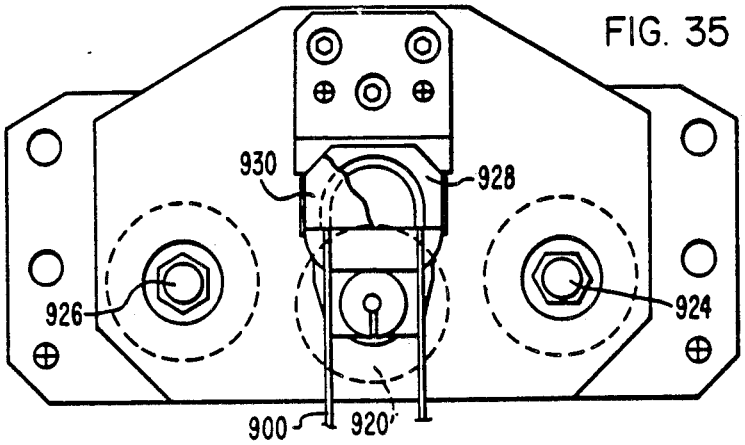
FIG. 35 is a top view of the wire turnaround.
Figure 34:
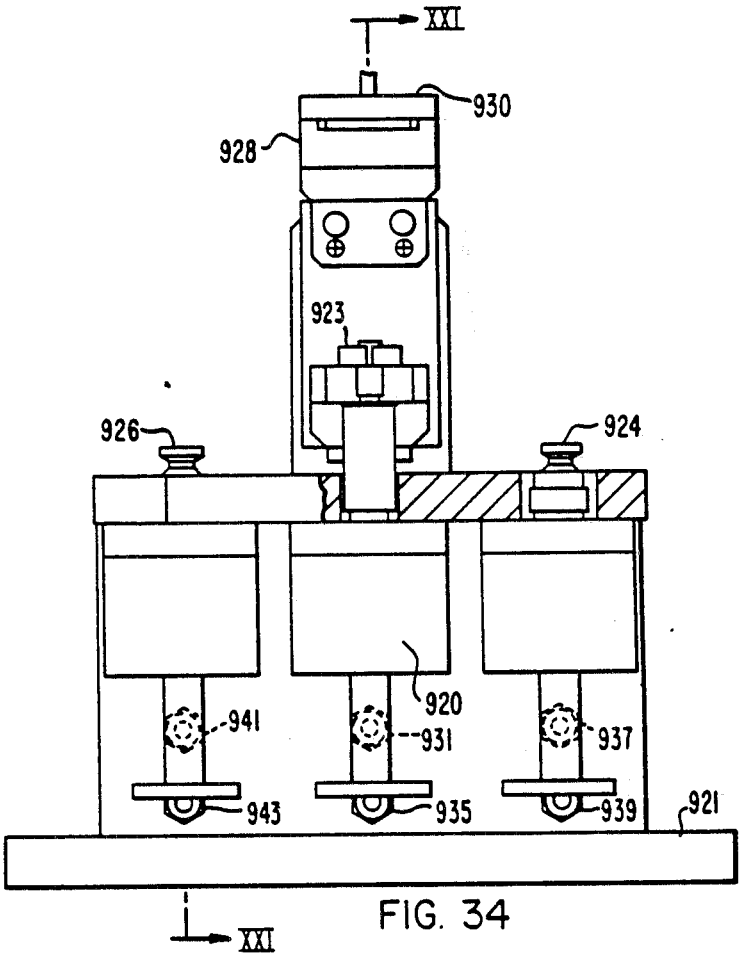
FIG. 34 is a front view of the wire turnaround.

FIGS. 34 and 35 are respectively the front and more detailed top views illustrating the wire turnaround. From these illustrations the turnaround groove in the bottom piece of the wire turnaround apparatus 928 as well as the top plate is also seen. Similarly, in FIG. 34 the pneumatic cylinder 920 which drives the lower half of the wire turnaround up and down as previously required is also clearly visible. Sensors 931 and 935 produce signals indicating the position of the wire turnaround. Similarly, sensors 941 and 943 generate signals indicating the position of wire clamp opening plunger 926. Sensor 937 and 939 generate signals indicating the position of wire clamp opening plunger 924. The output signals of these sensors is coupled to the control system 402 (FIG. 17) and in response thereto, the control system generates signals to activate the wire feed and cut station 426 and the wire turnaround system as discussed above.

For purposes of explaining the operation of the wire turnaround apparatus, the first step in the wire loading process is to activate the pusher cylinder 673 of FIG. 28 to engage both of the pusher brackets, 666 and 668, illustrated in FIG. 24 to move the wire support clamps, 656 and 658, such that they are directly in front of the front shear block 914 as illustrated in FIG. 32. Pneumatic cylinder 920 is used to raise the lower portion 918 of the wire turnaround into an elevated position, also illustrated in FIG. 32. After the lower portion 918 of the wire turnaround 918 has been raised, the upper portion 928 of the wire turnaround is lowered as illustrated in FIGS. 32 and 33. Clamp opening solenoids 924 and 926 are then activated to open the wire support clamps 658 and 660. After positioning of the wire turnaround and wire support clamps, as described above, the wire drive mechanism 910 illustrated in FIG. 25 is energized to feed the wire 900 through the shear blocks, 912 and 914, around the U-shaped portion of the turnaround and back through shear blocks, 914 and 912. Once this is achieved, the pneumatic cylinder 924 is activated to close the wire clamps 756 as illustrated in FIG. 32, cylinder 920 is utilized to lower the bottom half 928 of the wire turnaround and the top half 930 is lifted using suitable mechanisms. Following this the wire drive mechanism is again actuated to feed additional wire through wire support clamp 658 with the excess being accumulated in the wire container 649 as illustrated in FIG. 20. When a suitable length of wire has been loaded, the second wire support clamp 658 is closed and the rear shear block 912 is moved upward by pneumatic cylinder 916 shearing the wire 900 at the interface of the shear blocks 912 and 914. The pusher mechanism is then utilized to retract the wire support clamps to their normal position as illustrated in FIG. 21.

Figure 36:
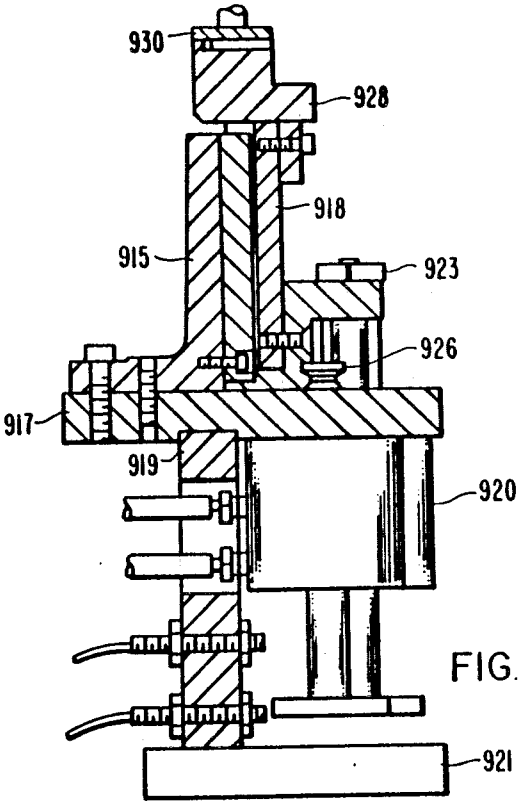
FIG. 36 is a side view of the wire turnaround.

FIG. 36 is a side view of FIG. 34. FIG. 36 is a side view of the wire turn apparatus. From this figure it is clear that a nut 923 is utilized to secure the piston rod of the pneumatic cylinder 920 to the vertical support member 918 for the lower section 928 of the wire turnaround. Upright member 918 is slidably secured to a second support member 915. This member is ultimately affixed to a plate mechanism 917 utilizing screws. Plate 917 is in turn affixed to a second vertical member 919 which is in turn affixed to the base support mechanism 922. The base support 921 is in turn secured to the support table for the system. Two position sensors indicate whether the wire turnaround is in its raised or lowered position. Two air inlets alternately determine whether the mechanism is in its raised or lowered position.

Figure 37:
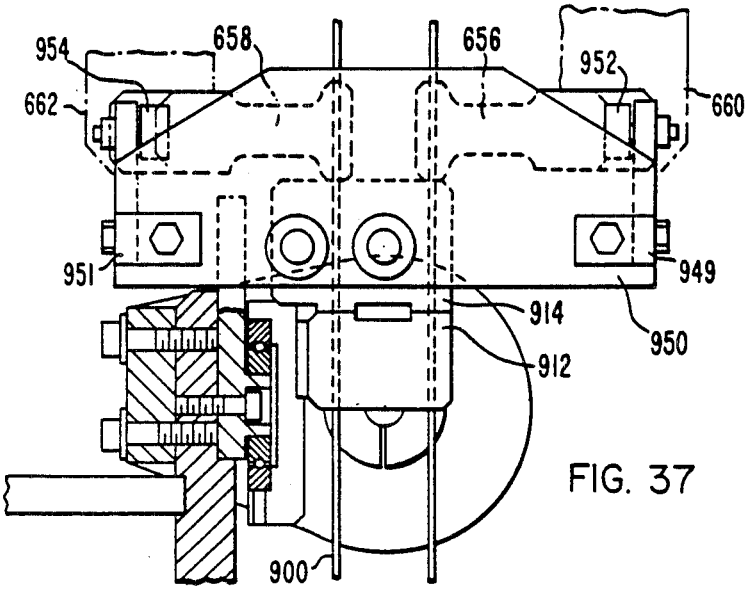
FIG. 37 is a top view of the wire shear.

When the wire holding clamps, 656 and 658, as well as the wire turnaround apparatus is fixed in a position for loading wire into the container as discussed above, it is also desirable that the wire support clamps, 656 and 658, be provided with vertical support, assuring that the wire holding grooves in these clamps precisely line up with the wire openings in the shear block 914. This is accomplished by affixing to the top surface of the front shear block 914 a substantially flat plate 950 illustrated in FIG. 37. Near the edges of this plate are two grooves into which L-shaped brackets 949 and 951 are affixed. Two rollers 952 and 954 are affixed to the arms, 949 and 951, such that when the wire support clamps, 656 and 658, are positioned adjacent to the front shear block 914, as they are in the wire loading position, the plates, 660 and 662, to which the wire clamps, 656 and 658, are affixed, rest on the top surface of the rollers, 952 and 954, so as to hold the grooved portions of the wire holding clamps, 656 and 658, substantially aligned with the openings in the shear blocks 914. This permits the wire clamps to be vertically aligned as required for wire loading. Two screws, 953 and 955, are provided to adjust the arm portions, 949 and 951, vertically with respect to the plate 960 to provide precise vertical alignment. The horizontal alignment pin 806 (FIG. 30) is used to provide substantially precise horizontal alignment.

Figure 39:
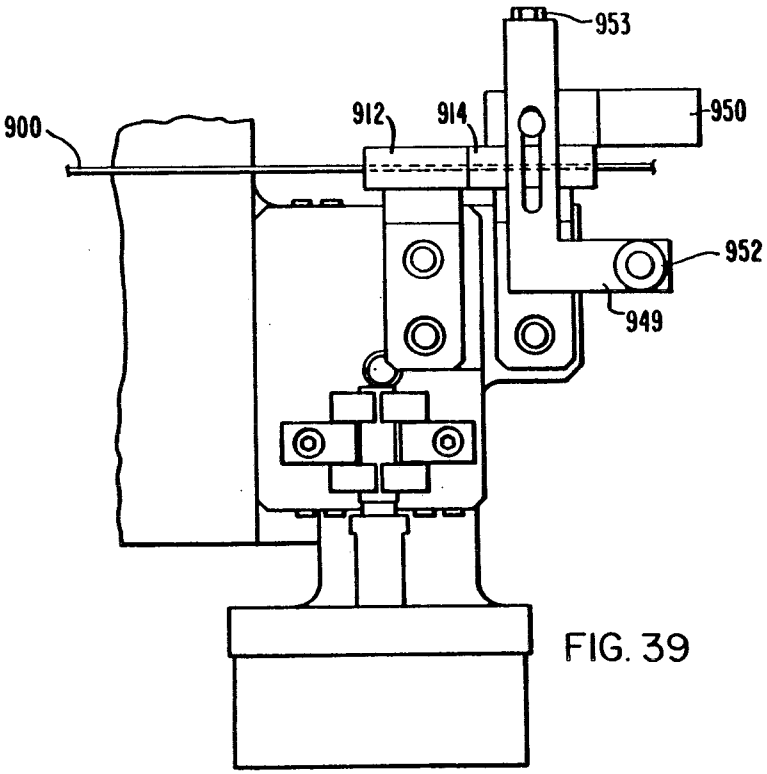
FIG. 39 is a side view of the wire shear.
Figure 38:
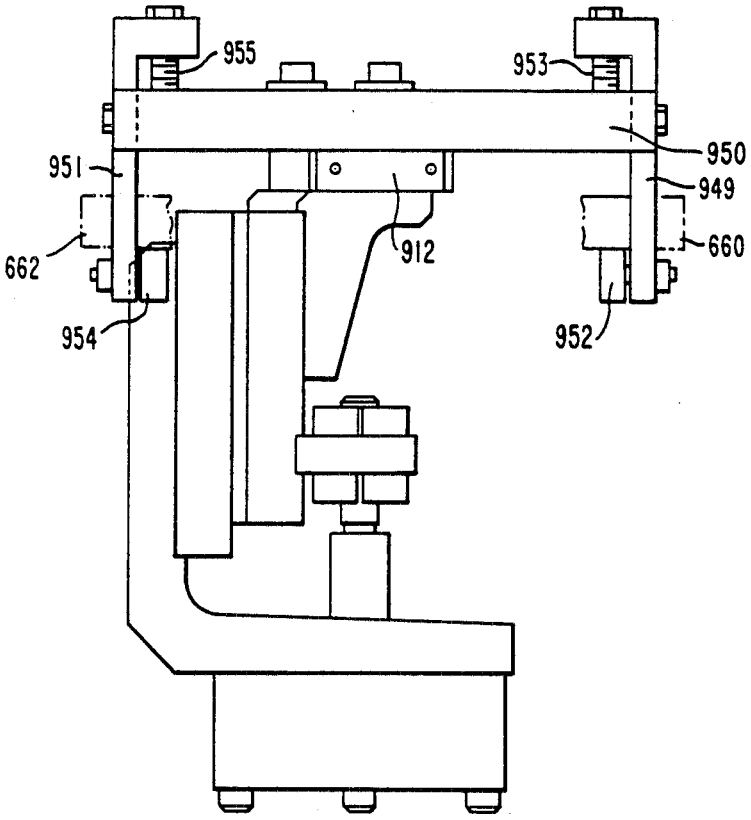
FIG. 38 is a front view of the wire shear.

A side view of FIG. 38 is illustrated in FIG. 39 in order to more precisely show the design of the plate member 950 as well as the arms, 949 and 951.

In the process of loading wires into the wire support clamps, 656 and 658, as previously discussed, the wire turnaround apparatus invariably leaves some bend in the wire end portions, 413 and 415. In the operation of the system, it is highly desirable for the end portions, 413 and 415, of the wires to be supported in the wire support clamps (656 and 658) such that they extend outwardly from the clamps a known distance and at substantially right angles with respect to the wire clamps. This being the case it is necessary to utilize a wire straightener to straighten the wires after they have been loaded into the wire support clamps 656 and 658. Apparatus 428 for straightening the wire is illustrated in FIG. 40.

The wire straightener 428 will be discussed with reference to a single lead held in wire support clamps 656. The leads in each of the wire support clamps are straightened separately using an identical process. Therefore, only one will be described.

The first step in straightening a lead is to utilize the push bar 670 to position the wire support clamp 656 in its forward position such that the lead to be straightened is positioned between the jaws 1000 and 1002 of the wire straightener 428. Once positioned within grip of the jaws, a pneumatic cylinder 1014 is utilized to pull a rod 1018 to the position as indicated in FIG. 20. In this position, the flange on the end of the rod 1018 is in grooves of the ends of the jaws 1000 and 1002, causing the front portions of the jaws to close tightly on the wire lead. An electric motor 1010 is coupled to a pulley 1012 which is in turn coupled through pulley 1006 to the shaft portion 1004, causing the jaws of the straightener to rotate. Once the wire is positioned in the jaws of the straightener, the jaws closed and rotated, the pusher bar 670 is released to withdraw the wire support clamp 656 away from the front portions of the straightener jaws 1000 and 1002 and slowly pulls the wire from between the jaws. Once the wire has been fully extracted from the gripper jaws, the straightening operation is completed. However, it should be emphasized that the straightening operation can be repeated for as many cycles as is necessary, depending on the extent to which straightening is required.

Figure 40:
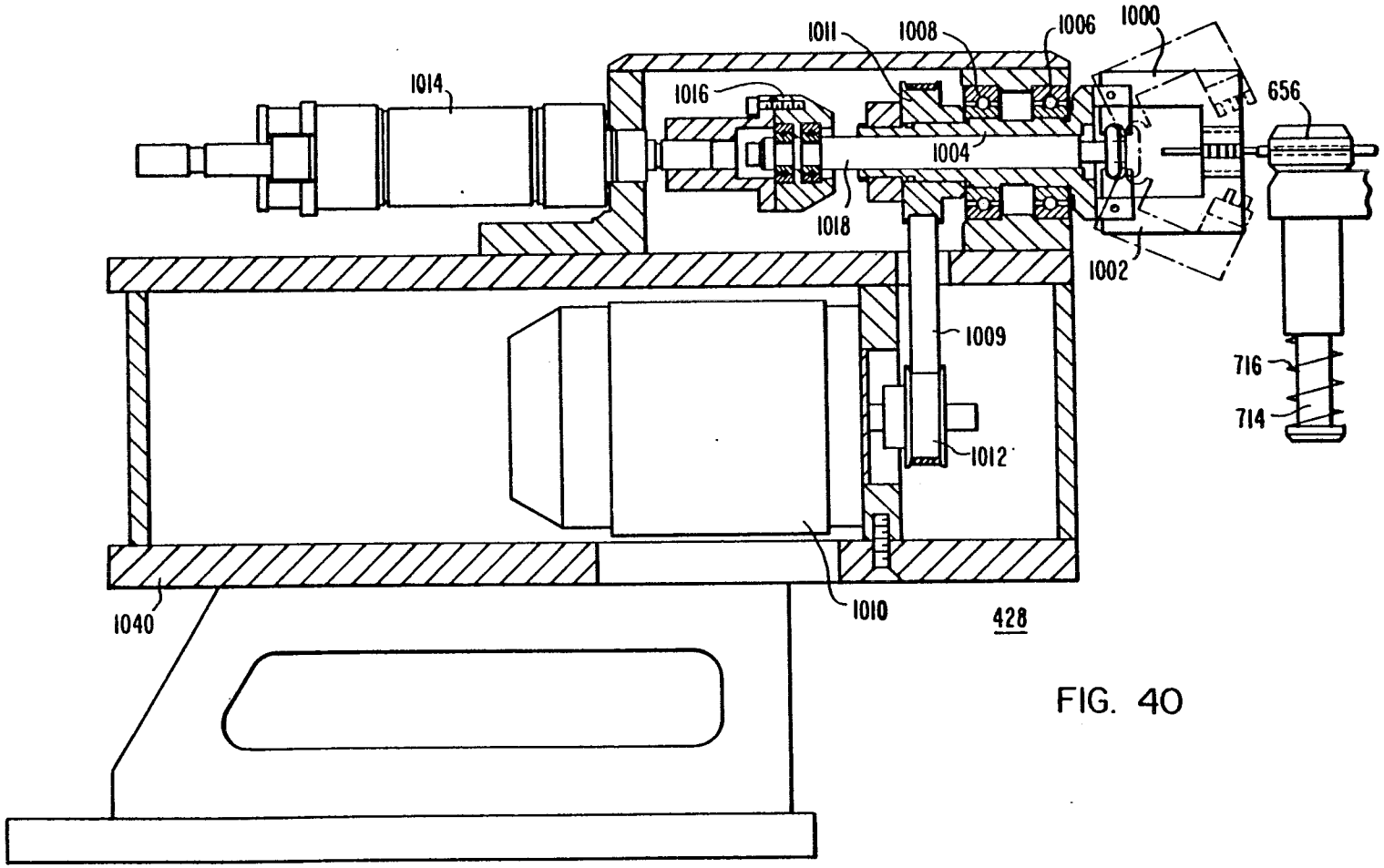
FIG. 40 is a side view of the wire straightener workstation.
Figure 41:
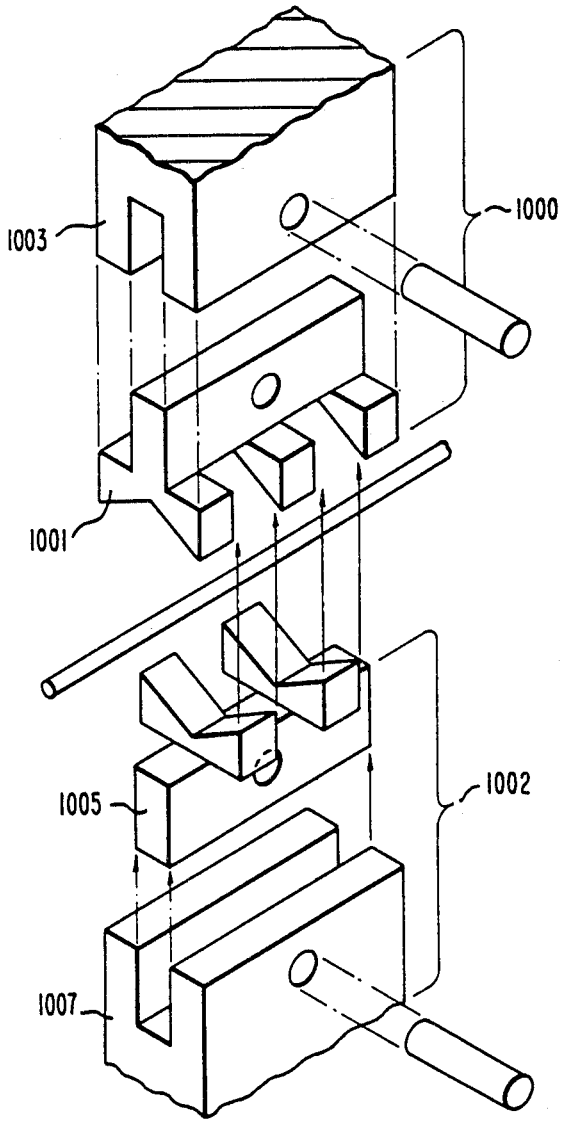
FIG. 41 is an isometric drawing of the wire straightener jaws.

To aid in further understanding of the wire straightener 428 illustrated in FIG. 40, each of the straightener jaws 1000 and 1002 are shown in further detail in FIG. 41. For example, straightener jaw 1000 contains a major support member 1003 partially illustrated in FIG. 41. In the end of this member is a groove for accepting the mating portion of the working head illustrated at reference numeral 1001. The working head 1001 includes a portion for extending into the groove in support member 1003 and is secured therein by a pin. The surface actually contacting the wire during the straightening operation comprises a plurality of substantially rectangular-shaped surfaces with pairs of the surfaces joining to form substantially V-shaped teeth-like structures. The point at which these surfaces join is substantially parallel to the rotational axis of the straightener. The second working head 1005 includes similar complementary surfaces. In operation, the opposed portions 1005 and 1001 of the straightener head form interleaving surfaces which apply opposed forces to alternating segments of the wire to be straightened. The heads are rotated and as the wire is withdrawn, these forces spiral down the surface of the wire, causing the wire to be straightened.

Figure 42:
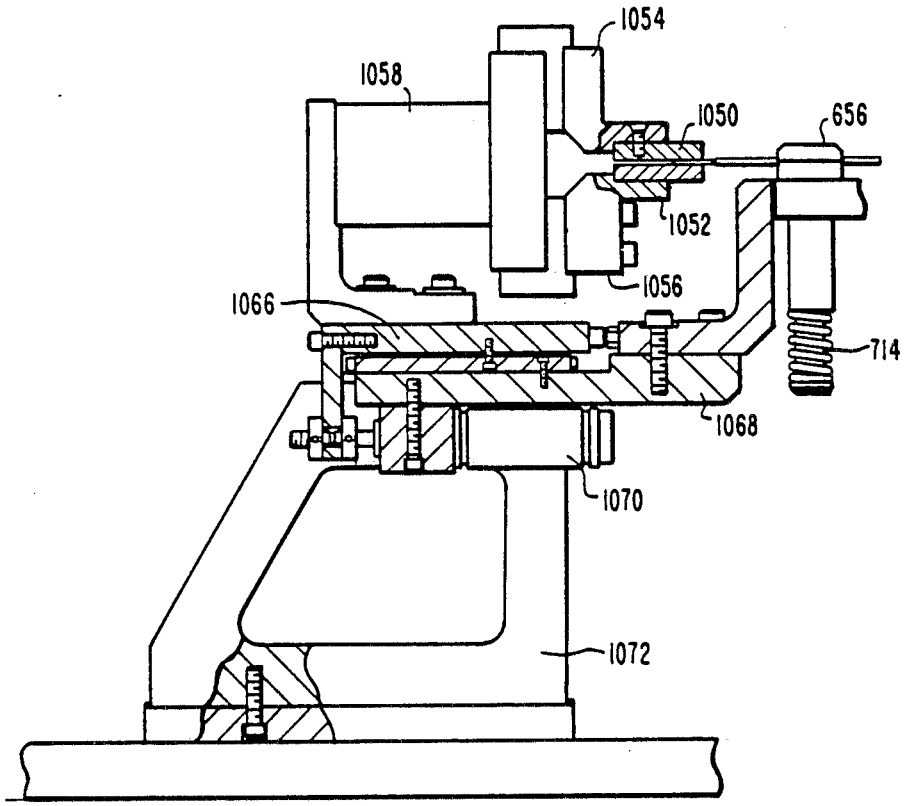
FIG. 42 is a side view of the terminal pull-test workstation.

FIG. 42 is a somewhat schematic diagram of a pull test workstation 470 which is designed to grip the wire and a terminal attached thereto and apply a force between the two to determine if the terminal is properly attached. More specifically, the wire gripper 656 grips the wire and positions it in front of the pull test workstation 470 as illustrated in FIG. 42. The pull test workstation 470 contains two opposed jaws 1050 and 1052 which close on the wire terminal as illustrated in FIG. 42. Each of the jaws 1050 and 1052 are preferably electrically conductive and are electrically insulated from the remaining portions of the system by two insulators 1054 and 1056. The insulators are mounted to a gripper mechanism 1058 which is in turn secured to the rod portion of a pneumatic cylinder 1070 by a bracket 1066. Air pressure is appropriately applied to the pneumatic cylinder 1066 to apply force to the terminals secured to the wire. Should the terminal not be appropriately crimped, no retraining force will be applied with the pneumatic cylinder 1070 is actuated and the motion will be detected to indicate that the terminal was improperly applied.

Sensors to provide the signals indicating the operating parameters of the pull test are provided to the control system 402 and in response thereto control signals to operate the pull test workstation are provided.

FIG. 43 is a drawing that illustrates generally the workstation for marking the wires. Functionally this is a substantially standard piece of equipment which uses ink spraying techniques to mark the individual leads. The lead to be marked is held in one of the wire clamps, for example wire clamp 656. The free end of the wire is held between the jaws 1078 and 1080 of a gripper forming a part of the marking system. The marking system includes a pneumatic cylinder 1074 for applying tension to the wire so that it is tightly suspended between the jaws of the gripper and the wire clamp 656. In this position, a spray head 1082 is used to print the desired identifying marks on the wire lead.

Sensors included in the marking system 472 provide signals indicating its operating parameters to the control system 402. Control system 402 generates the signals necessary to operate the marking system 472.

Figure 44:
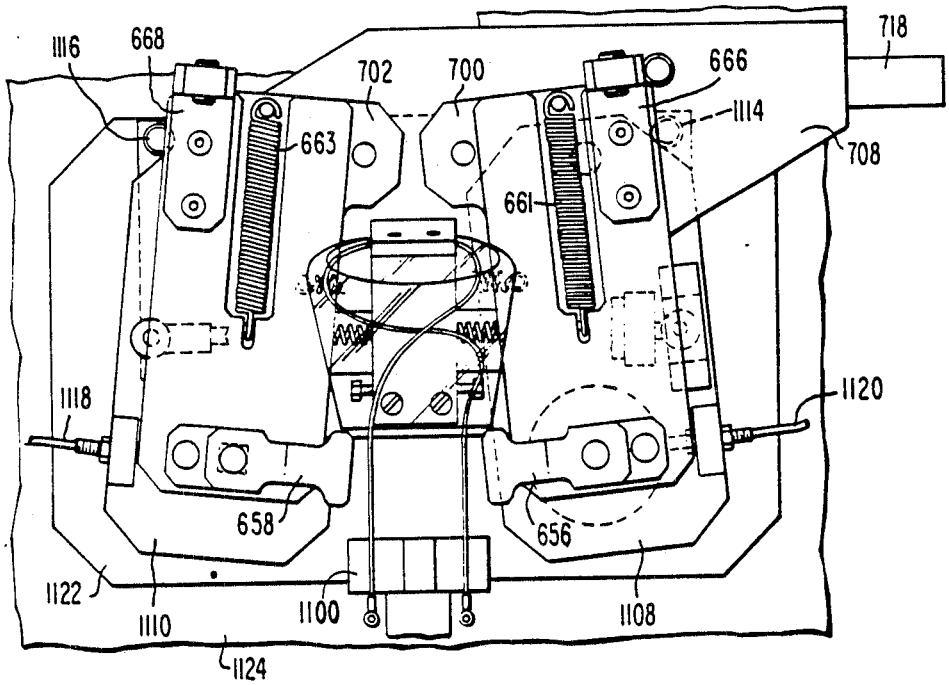
FIG. 44 is a top view of the wire transport pallet with the wire gripper rotated outward and including a portion of the wire unload gripper.
Figure 45:
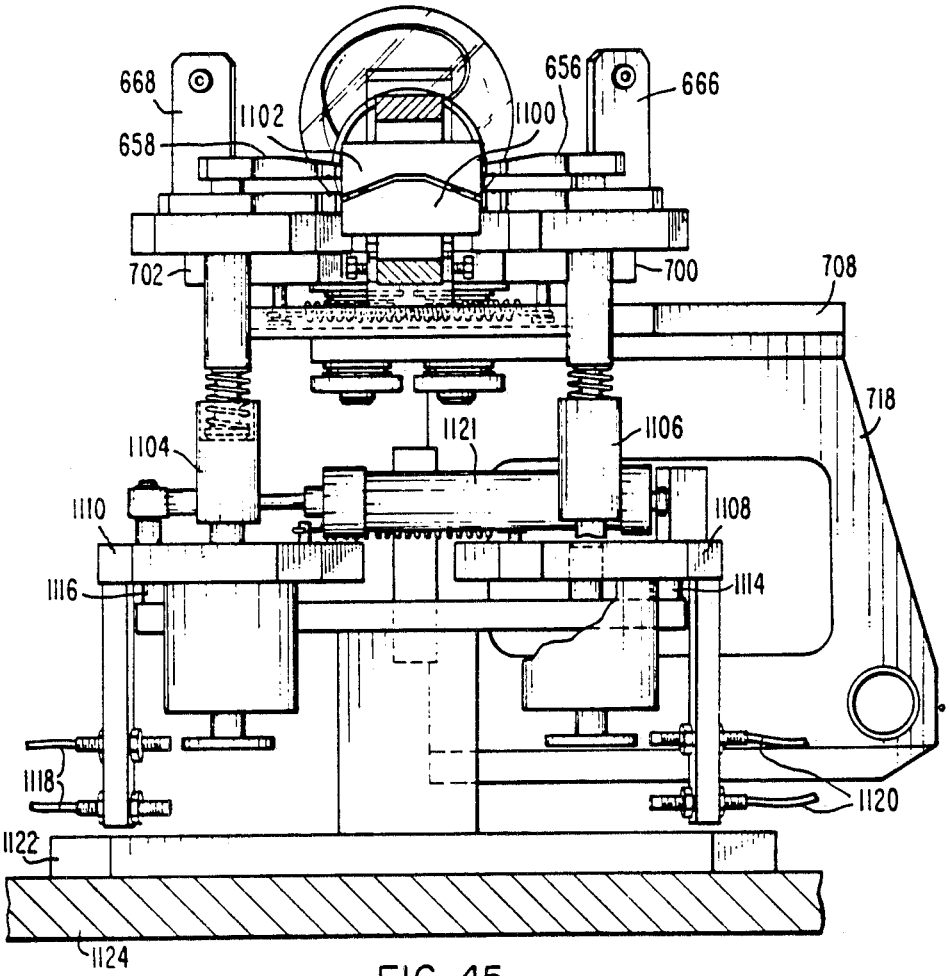
FIG. 45 is a front view of the wire transport pallet illustrating wire unload.

The final operation in the wire preparation system is to remove the finished lead wire from the system and pass it on to the cable harness assembly process. Functionally this is accomplished at the unload station 477 by using a gripper having two jaws, 1100 and 1101, (FIG. 45) to grip the free ends of the lead. After the jaws, 1100 and 1101, are closed on the leads, the wire clamps, 656 and 658, are released and the clamps are rotated outwardly to provide space for removing the wire from the glass container. Functionally this is accomplished by actuating pneumatic cylinders causing the tubular members, 1104 and 1106, as illustrated in FIG. 45 to rise and surround the push rods of the grippers. The springs are compressed, opening the grippers. The actuators are affixed to two plates 1108 and 1110 which are hinged to rotate about pivot points 1114 and 1116 illustrated in FIG. 44. A pneumatic cylinder 1120 is then actuated to rotate the plates 1110 and 1118 about these pivot points, causing the wire grippers, 656 and 658, to be rotated outwardly as illustrated in FIG. 44. Sensors, 1118 and 1120, indicate when the grippers 656 and 658 are open. A similar sensor is utilized to detect when the pneumatic cylinder 1120 has reached its travel limits, indicating that the clamps are positioned in the open position as illustrated in FIG. 44. In this position, an actuator simply pulls the wire from the container by moving the gripper jaws, 1101 and 1100, in a horizontal direction.

Figure 46:
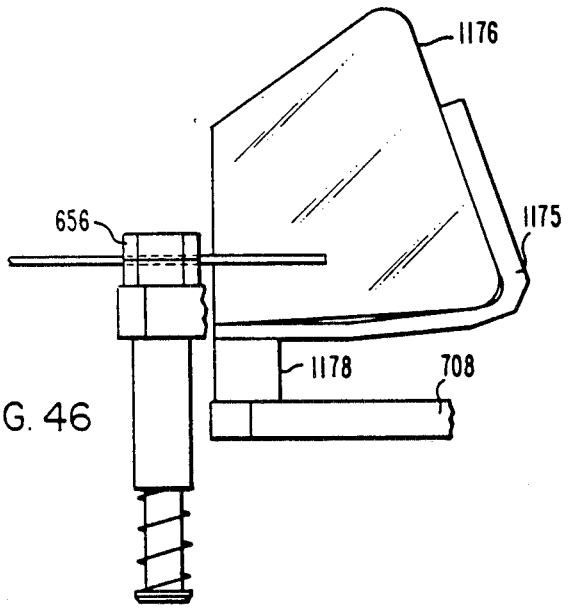
FIG. 46 is a side view of the wire container.

FIG. 46 is a more detailed drawing illustrating the container for the wire 1176. This container is affixed to a bracket member 1175 which is in turn spaced from plate member 708 by a block 1178. This positions the container 1176 in the position for receiving the wire.

As previously discussed, each of the wire support pallets 414 are sequentially indexed to each workstation position, including the positions indentified as "spare". At each station suitable actuation are provided to operate the wire support pallet 414. It should be emphasized that each of the workstations may not need all of the actuators.

Additionally, the workstations themselves are selected to perform the desired wire preparation function, with the function illustrated being examples only. The workstations themselves can range from essentially prior art apparatus such as the strippers, crimpers and marking systems which have been adapted to accept the wire ends from the wire transport pallets 414 to totally original functions such as the wire straightening workstation 428. Changing the mix or function of the workstation does not change or depart from the concept of the system.

We claim:

1. A flexible, automated cable harness fabrication system comprising:

(a) wire preparation apparatus including means for removing wire from bulk storage and means for cutting said wire into predetermined lengths to form conductors, means for storing each of said conductors in individual container means, means for sequentially indexing said container means to a plurality of work stations, means for operating said work stations to prepare the ends of said conductors to form prepared conductors for use in said harness;

(b) cable harness forming apparatus for sequentially routing individual ones of said prepared conductors along a predetermined path;

(c) means for feeding or transporting the said prepared conductors from said wire preparation system to said cable harness forming system; and (d) computing means for processing cable harness design data and for providing operative control signals to said wire preparation apparatus and said cable harness forming apparatus to fabricate cable harness.

2. The system set forth in claim 1, wherein the wire preparation system includes a plurality of stations for terminating the wire ends with preselected electrical terminals.

3. The system set forth in claim 1, wherein the cable harness forming apparatus includes:

means for presenting a prepared conductor to a selected end effector;

means for loading said prepared conductor into said selected end effector;

means for positioning said selected end effector for insertion of a first end of said prepared conductor into a desired first assembly point;

means for inserting said first end of the prepared conductor into the first assembly point;

means for routing said prepared conductor along a predetermined cable harness layout path;

means for loading a second end of said prepared conductor into said selected end effector;

means for positioning the end effector for insertion of said second end of said prepared conductor into a desired second assembly point; and means for inserting the second end of said prepared conductor into a desired second assembly point.

4. The system set forth in claim 3, wherein the means for positioning the end effector for the insertion of a terminated wire into a desired assembly point is an orthogonal robot capable of transporting the selected end effector in the X, Y and Z axes.

5. The system set forth in claim 3, wherein the selected end effector is chosen from a plurality of dedicated end effectors, each of which dedicated end effector is adapted to accommodate a specific style of prepared conductor.

6. A flexible automated wiring harness fabrication system comprising:

(a) a wire preparation apparatus utilizing wire (conductor) of selected sizes and types stored in bulk form to produce prepared conductors (ready to assemble into a finished wiring harness) of a selected quantity and type;

(b) a harness fabrication apparatus utilizing said prepared conductors to produce a wiring harness:

(1) said wire preparation system including (a) means for removing selected lengths and types of wires from storage to form individual conductors of varying lengths and types;

(b) a plurality of container means for individually storing each of said conductors;

(c) a plurality of support means for supporting first and second ends of each of said individual conductors such that said first and second ends extend outward from the associated container and are substantially parallel to each other;

(d) transport means supporting each of said plurality of container means and each of said plurality of support means in a selected relationship to each other;

(e) indexing means for sequentially indexing each of said plurality of container at each of a plurality of work stations;

(f) control means for selectively operating said work station to selectively perform wire preparation task on said first and second ends of each of said conductors to form prepared conductors; and (g) means for removing said prepared conductors from said wire preparation systems;

(2) said harness fabrication apparatus comprising (a) a form board including means to secure each end of each of said prepared conductor comprising said harness and means for supporting each prepared conductor comprising said harness in the desired path;

(b) a robot for acquiring each one of said prepared conductors, individually placing each end of each of said prepared conductors in associated support means and routing each of said prepared conductors of said harness along an associated path as defined by said form board, thereby:

(c) providing an automated system for removing wire of selected sizes and types from bulk storage, cutting said wire into desired lengths to form conductors, preparing the end of said conductors and assembling said conductors into finished wiring harnesses.

7. A flexible automated wiring harness fabrication system comprising:

(a) storage means for storing a plurality of wire types in bulk form;

(b) apparatus for supporting the free end of each wire stored in bulk form;

(c) a plurality of wire containers each adapted to store a predetermined length of a selected wire type;

(d) apparatus for withdrawing a wire of a selected type from said bulk storage as the free end of said wire is supported in a fixed position causing a predetermined length of said wire to accumulate in a selected wire container;

(e) shear apparatus for cutting said wire to remove a section of wire from said free end and at a second position selected to produce a conductor of a selected length;

(f) first and second means for holding first and second ends of said conductor of a predetermined length such that said first and second ends extend outward from said container and are substantially parallel to each other;

(g) a plurality of work stations each adapted to perform a selected conductor preparation function on at least one of said first and second ends;

(h) transport means for supporting said container and said first and second holding means in a predetermined relationship to each other and for sequentially indexing said container and said means for holding said first and second ends to position said first and second ends within working range of each of said work stations;

(i) control means for controlling said transport means to position selected ones of said first and second ends to selected work stations;

(j) control means for controlling said selected work station to perform a selected preparation function on said selected end;

(k) automated apparatus for assembling siad conductors to form said wiring harness.

* * * * *